US005872546A

United States Patent [19]

Ihara et al.

[11] Patent Number: 5,872,546

[45] Date of Patent: Feb. 16, 1999

[54] BROADBAND ANTENNA USING A SEMICIRCULAR RADIATOR

[75] Inventors: Taisuke Ihara; Koichi Tsunekawa; Makoto Kijima, all of Yokosuka, Japan

[73] Assignee: NTT Mobile Communications Network Inc., Tokyo, Japan

[21] Appl. No.: 714,262

[22] Filed: Sep. 17, 1996

[30] Foreign Application Priority Data

Sep. 27, 1995 [JP] Japan ..... 7-249712
Dec. 11, 1995 [JP] Japan ..... 7-321906

[51] Int. Cl.[6] ..... H01Q 9/28

[52] U.S. Cl. ..... 343/795; 343/807; 343/830; 343/893

[58] Field of Search ..... 343/767, 770, 343/807, 797, 895, 795, 829, 830, 893, 896, 897, 898, 846; H01Q 9/28, 9/40

[56] References Cited

U.S. PATENT DOCUMENTS 3,364,491 1/1968 Stohr ..... 343/807
3,401,387 9/1968 Milligan et al. ..... 343/767
4,843,403 6/1989 Lalezari et al. ..... 343/767
5,309,165 5/1994 Segal et al. ..... 343/767

FOREIGN PATENT DOCUMENTS

565051 A1 10/1993 European Pat. Off. .
1301376 8/1969 Germany .
1541514 10/1969 Germany .

OTHER PUBLICATIONS

Patent Abstracts of Japan, E395, vol. 10, No. 95, Apr. 12, 1986, 60–237701.
Patent Abstracts of Japan, E145, vol. 6, No. 243, Dec. 2, 1982, 57–142003.

*Primary Examiner*—Michael C. Wimer
*Attorney, Agent, or Firm*—Pollock, Vande Sande & Amernick

[57] ABSTRACT

In a broadband antenna using a semicircular conductor disc, a semicircular cutout is formed in the semicircular radiator concentrically therewith. Alternatively, a semicircular arc-wise radiating conductor with a semicircular cutout defined concentrically therewith is bent into a cylindrical shape to form a radiator.

13 Claims, 21 Drawing Sheets

BROADBAND ANTENNA USING A SEMICIRCULAR RADIATOR

BACKGROUND OF THE INVENTION

The present invention relates to an antenna which has a bandwidth as broad as 0.5 to 13 GHz, for instance, but is small in size and, more particularly, relates to an antenna using a semicircular radiator or semicircular, ribbon-shaped radiator.

In R. M. Taylor, "A Broadband Omnidirectional Antenna," IEEE AP-S International Symposium, 1994, p1294, there is disclosed a conventional broadband antenna using semicircular conductor discs as depicted in FIG. 1. This conventional antenna has two elements. One of the elements is composed of two semicircular conductor discs $\mathbf{12}_{1a}$ and $\mathbf{12}_{2a}$, which have a common center line Ox passing through the vertexes of their semicircular arcs and cross at right angles. The other element is also composed of two elements $\mathbf{12}_{1b}$ and $\mathbf{12}_{2b}$, which similarly have a common center line Ox passing through the vertexes of their semicircular arcs and cross at right angles. The two elements are assembled with the vertexes of their circular arcs opposed to each other. A feeding section is provided between the vertexes of the arcs of the two elements; a coaxial cable 31 for feeding is disposed along the center of one of the two elements, with the outer conductor of the cable held in contact with the element.

FIG. 2 illustrates a simplified version of the antenna depicted in FIG. 1, which has semicircular conductor discs 12*a* and 12*b* disposed with the vertexes of their semicircular arcs opposed to each other. The feeding section is provided between the vertexes of the two conductor discs 12*a* and 12*b* to feed them with the coaxial cable 31 installed in the conductor disc 12*b*.

FIG. 3 shows the VSWR characteristic of the antenna depicted in FIG. 2. It will be seen from FIG. 3 that the simplified antenna also has a broadband characteristic, which was obtained when the radius r of each of the semicircular conductor discs 12*a* and 12*b* was chosen to be 6 cm. The lower limit band with VSWR<2.0 is 600 MHz. Since the wavelength λ of the lower limit frequency in this instance is approximately 50 cm, it is seen that the radius r needs to be about (⅛)λ. The radiation characteristic of the antenna shown in FIG. 1 is non-directional in a plane perpendicular to the center line Ox, whereas the radiation characteristic of the antenna of FIG. 2 is non-directional in a frequency region from the lower limit frequency to a frequency substantially twice higher and is highly directive in the same direction as the radiator 12*a* in the plane perpendicular to the center line Ox.

Thus, the conventional antenna of FIG. 1 comprises upper and lower pairs of antenna elements each formed by two sectorial radiators crossing each other, and hence it occupies much space. Also in the simplified antenna of FIG. 2, the sectorial semicircular radiators are space-consuming. In terms of size, too, the conventional antennas require semicircular conductor discs whose radii are at least around ⅛ of the lowest resonance wavelength; even the simplified antenna requires a 2r by 2r or (¼)λ by (¼)λ antenna area. Accordingly, the conventional antennas have defects that they are bulky and space-consuming and that when the lower limit frequency is lowered, they become bulky in inverse proportion to it.

SUMMARY OF THE INVENTION

It is therefore an object of the present invention to provide an antenna which has the same electrical characteristics as in the prior art but is less bulky, or an antenna which is smaller in size and lower in the lowest resonance frequency than in the past.

The antenna according to a first aspect of the present invention is characterized by a semicircular arcwise radiator with a substantially semicircular space or area defined inside thereof (hereinafter referred to as a cutout). A plane conductor ground plate is placed in a plane perpendicular to the radiator in opposing relation to the vertex of its circular arc and a feeding point is located at the vertex of the circular arc. Alternatively, another radiator of about the same configuration as the above-mentioned is disposed with the vertexes of their circular arcs opposed to each other and the vertexes of their circular arcs are used as feeding points.

At least one radiating element, different in shape from the semicircular arcwise radiator, may be disposed in its semicircular cutout and connected to the vicinity of the feeding point.

The antenna according to a second aspect of the present invention is characterized in that a semicircular conductor disc as a radiator is bent into a cylindrical form.

In the antenna according to the second aspect of the invention, it is also possible to employ a configuration in which a plane conductor ground plate is disposed opposite the vertex of the circular arc of the cylindrical radiator in a plane perpendicular thereto and the vertex of the circular arc is used as a feeding point, or a configuration in which another semicircular radiator having the vertex of its circular arc opposed to that of the cylindrical radiator is disposed in parallel thereto and the vertexes of their circular arcs are used as feeding points.

In the antenna according to the second aspect of the invention, when the cylindrical semicircular radiator is a semicircular arcwise radiator with a substantially semicircular cutout defined inside thereof, at least one radiating element different in shape therefrom may be disposed in the cutout and connected to the vicinity of the feeding point.

With the antennas according to the first and second aspect of the invention, it is possible to reduce the space for the antenna element while retaining the same broadband characteristic as in the past, by defining the semicircular cutout in the semicircular radiator to form the arcwise radiator and/or bending the semicircular or arcwise radiator into a cylindrical form. Furthermore, by incorporating another radiating element in the cutout of the semicircular radiator, it is possible to achieve a multi-resonance antenna without upsizing the antenna element, and the VSWR characteristic can be improved as compared with that in the prior art by bending the semicircular radiator into a cylindrical form.

DESCRIPTION OF THE PREFERRED EMBODIMENTS

Figure 4:
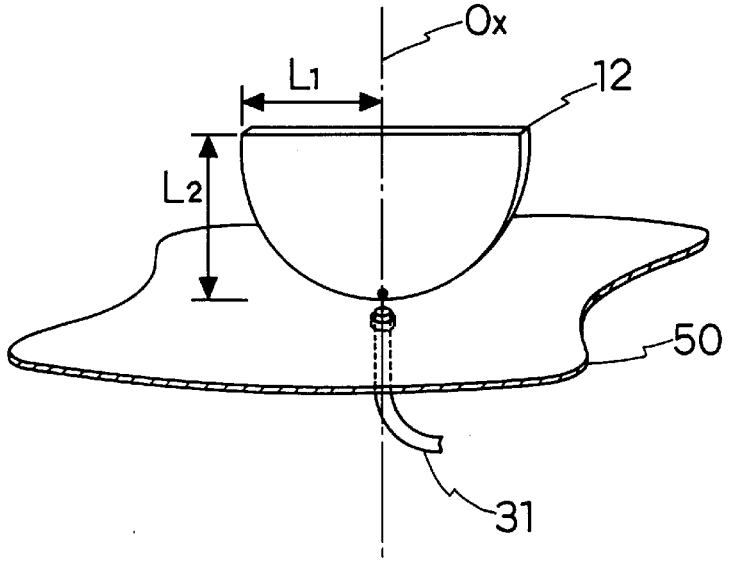
FIG. 4 is a perspective view of an antenna structure on which the present invention is based.

To facilitate a better understanding of the present invention, a description will be given first of a monopole antenna which comprises a semicircular radiator disc, which is one of the radiating elements of the dipole antenna shown in FIG. 1, and a plane conductor ground plate serving as a mirror image plane and is equivalent in operation to the antenna of FIG. 1. As shown in FIG. 4, the monopole antenna was formed by placing a semiconductor radiator 12 on a plane conductor ground plate 50 vertically thereto with the vertex of the circular arc of the former held in adjacent but spaced relation to the latter and connecting center and outer conductors of a coaxial feeding cable 31 to the vertex of the circular arc of the semicircular radiator 12 and the ground plate 50, respectively. As described just below, analyses were made of the monopole antenna shown in FIG. 4. Since the conductor ground plate 50 forms a mirror image of the radiator 12, the operation of this monopole antenna is equivalent to the operation of the antenna depicted in FIG. 2.

Figure 5A:
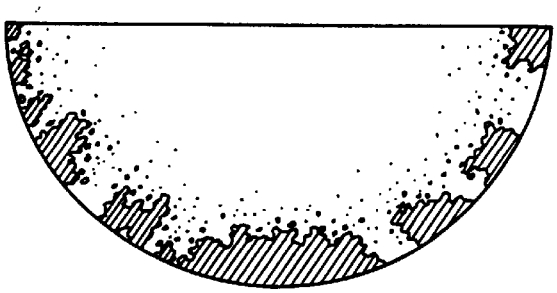
FIG. 5A is diagram showing the current density distribution on a radiator of the antenna structure of FIG. 4.

(a) The distribution of a 5 GHz high-frequency current on the radiator 12 was analyzed by a finite element method, from which it was found that high current density regions developed discontinuously along the circumference of the semicircular radiator 12 as shown by hatched areas in FIG. 5A, whereas the current flow in the central region was negligibly small—this indicates that the arcwise marginal area of the semicircular disc contributes largely to radiation.

(b) The shape of the semicircular radiator 12 in FIG. 4 was defined generally as an ellipse inclusive of a circle and the influence of the dimensional relationship between perpendicularly intersecting first and second radii $L_1$ and $L_2$ of the radiator 12 on the VSWR characteristic was measured under the three conditions listed below.

(1) $L_1=L_2=75$ mm (i.e. In the case of a semicircle)

(2) $L_1=75$ mm, $L_2=50$ mm (i.e. When $L_1>L_2$)

(3) $L_1=40$ mm, $L_2=75$ mm (i.e. When $L_1<L_2$)

Figure 5B:
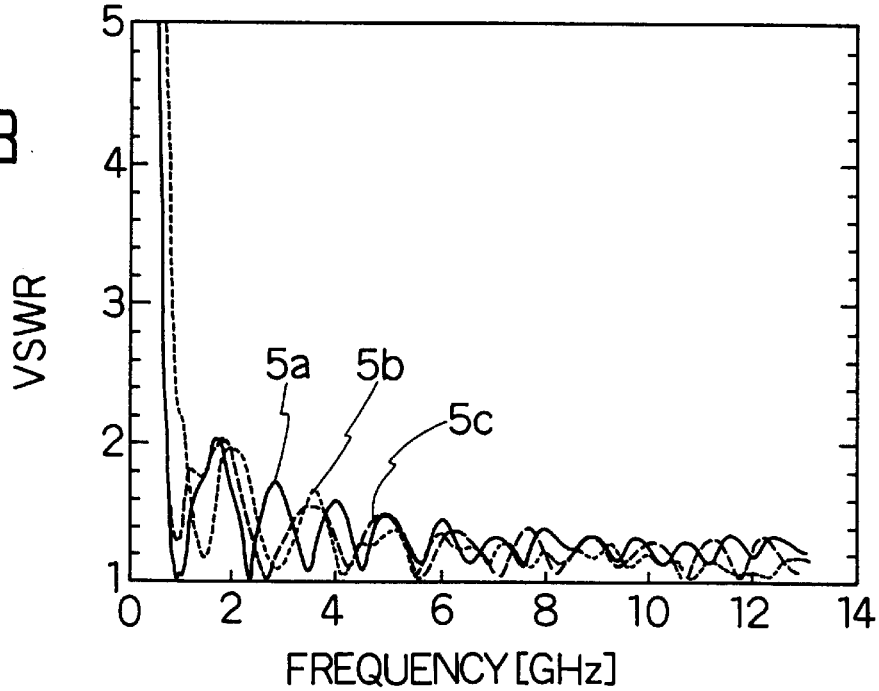
FIG. 5B is a graph showing the VSWR characteristics obtained with radiators of different shapes in the FIG. 4 structure.

In FIG. 5B there are shown the VSWR characteristics measured under the above-said three conditions, which are indicated by the solid, broken and thick lines 5*a*, 5*b* and 5*c*, respectively. From FIG. 4 it is seen that a change in the radius $L_2$ causes a change in the lower limit frequency of the band (a decrease in the radius $L_2$ increases the lower limit frequency) but that even if the semicircular form of the radiator is changed to an ellipse, no significant change is caused in the VSWR characteristic—this indicates that the radiator 12 need not always be perfectly semicircular in shape.

Based on the results of the analysis (a), a semicircular area of the semicircular radiator disc inside the arcwise marginal area thereof is removed to define a semicircular cutout, which is used to accommodate another antenna element or an electronic part or circuitry.

According to the results of the analysis (b), the VSWR characteristic remains substantially unchanged regardless of whether the radiator is semicircular or semi-elliptic. This applies to an arcwise ribbon-shaped radiating conductor for use in the embodiments of the present invention described hereinbelow.

FIRST EMBODIMENT

Figure 6:
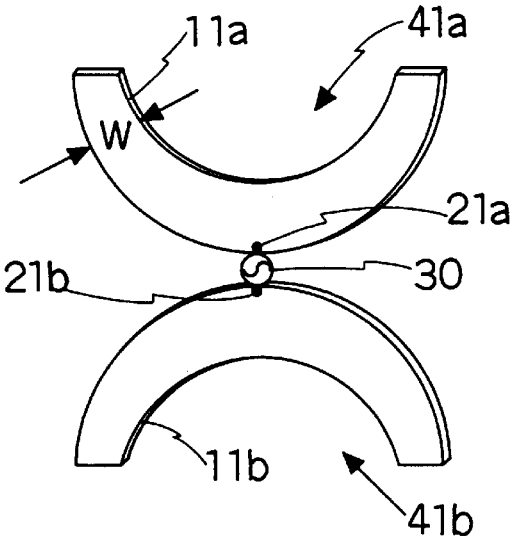
FIG. 6 is a perspective view illustrating a first embodiment of the present invention.

FIG. 6 is a perspective view illustrating the antenna structure according to a first embodiment of the present invention, which comprises a pair of substantially semicircular arcwise radiators 11*a* and 11*b* (made of copper or aluminum, for instance). The outer and inner marginal edges of each arcwise radiator 11 may be semicircular or semi-elliptic. The two radiators 11*a* and 11*b* are disposed with vertexes 21*a* and 21*b* of their circular arcs opposed to each other and a feeding section 30 is provided between the vertexes 21*a* and 21*b*. The two semicircular arcwise radiators 11*a* and 11*b* have centrally thereof substantially semicircular cutouts 41*a* and 41*b* concentric therewith. In the case where the radiators 11*a* and 11*b* are semicircular and the cutouts 41*a* and 41*b* are semi-ellipses each having the major axis, for example, in the horizontal direction, the widths W of radiators 11*a* and 11*b* gradually decrease or increase toward both ends of each radiator. When the cutouts each have the major axis in the vertical direction, the widths W of the radiators 11*a* and 11*b* gradually increase toward their ends. This antenna structure permits placement of other elements in the cutouts 41*a* and 41*b*, and hence it provides increased space factor as compared with the conventional antenna using completely semicircular conductor discs.

Figure 7:
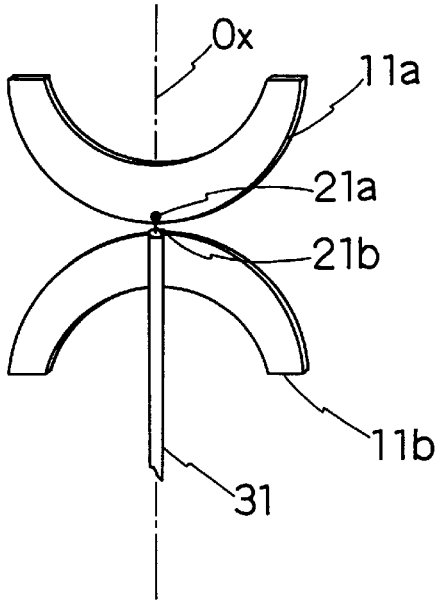
FIG. 7 is a diagram showing one mode of feeding in FIG. 6.
Figure 8:
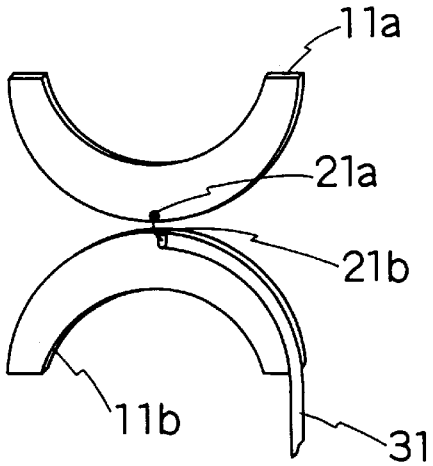
FIG. 8 is a diagram showing another mode of feeding in FIG. 6.
Figure 9:
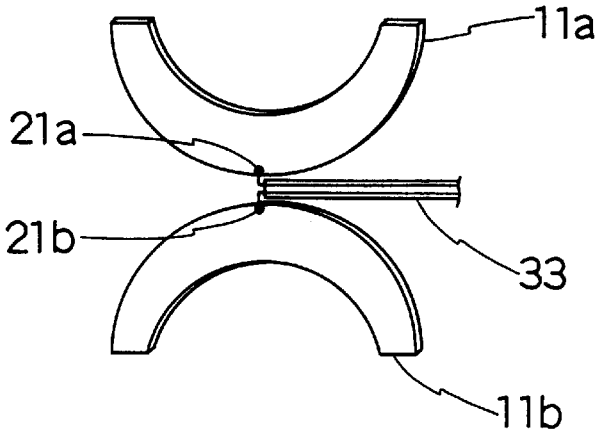
FIG. 9 is a diagram showing still another mode of feeding in FIG. 6.

FIGS. 7 through 9 show, by way of example, different feeding schemes for the antenna of the FIG. 4 embodiment. In FIG. 7 the coaxial cable 31 is disposed along the center line Ox of the radiator 11*b*, whereas in FIG. 8 the coaxial cable 31 is disposed along the semicircular outer periphery of the radiator 11*b*. In FIG. 9 a twin-lead type feeder 33 is used. In any case, feeding is carried out between the vertexes 21*a* and 21*b* of the two radiators 11*a* and 11*b*.

Figure 3:
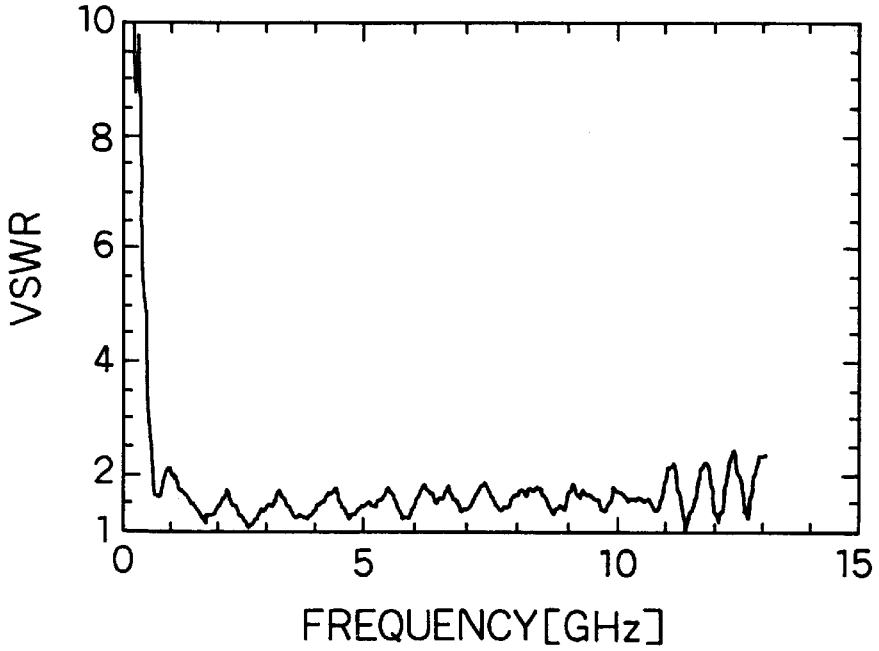
FIG. 3 is a graph showing the VSWR characteristic of the antenna depicted in FIG. 2.
Figure 10A:
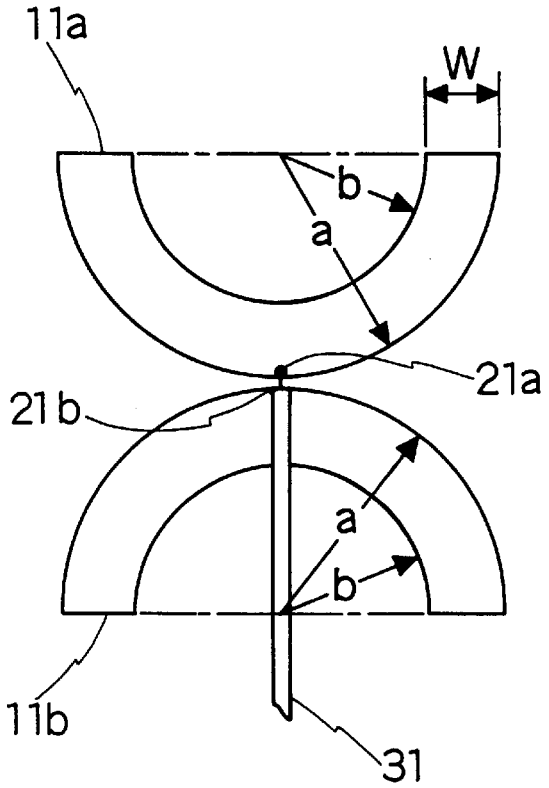
FIG. 10A is a front view of the FIG. 6 antenna structure on which experiments were conducted.
Figure 10B:
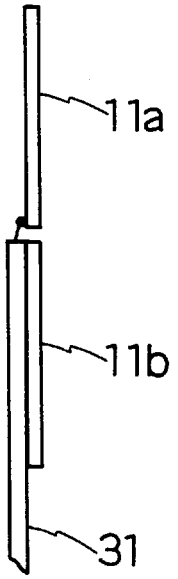
FIG. 10B is its plan view.
Figure 10C:
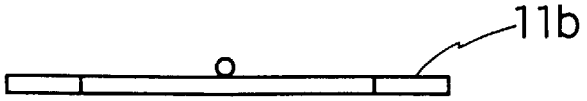
FIG. 10C is its side view.
Figure 11:
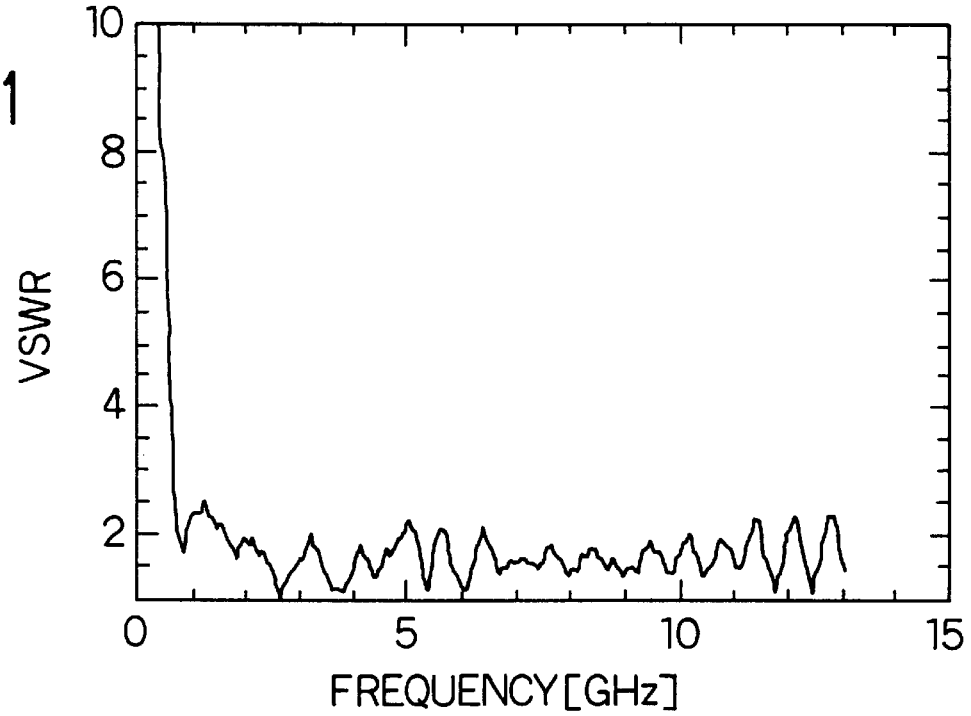
FIG. 11 is a graph showing the measured VSWR characteristic.

An experiment was conducted to verify or determine the performance of the antenna of this embodiment. FIG. 10 shows its front, right-hand side and plan views, and FIG. 11 shows the VSWR characteristic measured in the experiment. In the experiment the outside shape of each of the radiators 11*a* and 11*b* was a semicircle with a radius a=75 mm and the shape of each of the cutouts 41*a* and 41*b* was a semicircle concentric with the outside shape of each radiator and having a radius b=55 mm. Accordingly, the widths W of the radiators 11*a* and 11*b* were 20 mm. The coaxial cable 31 disposed along the center axis of the radiator 11*b* was used for feeding, the coaxial cable 31 having its center conductor connected to the vertex 21*a* of the radiator 11*a* and its outer conductor connected to the other radiator 11*b*. Comparison of the VSWR characteristic thus obtained with the VSWR characteristic of the prior art example shown in FIG. 3 indicates that the VSWR is limited to about 2 or smaller value in a frequency region above 600 MHz and that the band characteristic is about the same as that of the prior art example regardless of the cutouts of the radiators. The provision of the cutouts enhances the space factor because a circuit device, another radiating element or the like can be placed in the cutout of each radiator.

SECOND EMBODIMENT

Figure 12:
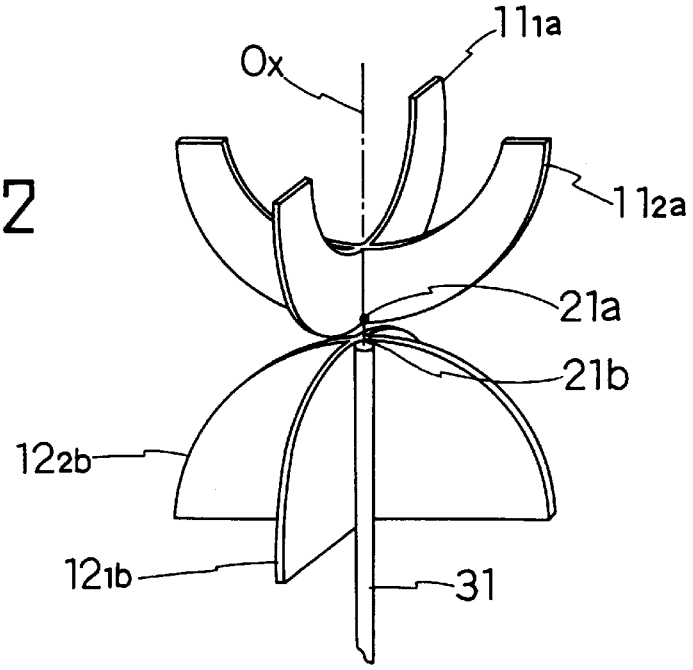
FIG. 12 is a perspective view illustrating a second embodiment of the present invention.

FIG. 12 illustrates in perspective the antenna structure according to a second embodiment of the present invention. The antenna of this embodiment is provided with two sets of antenna elements, one of which is composed of a pair of substantially semicircular conductor discs $\mathbf{12}_{1b}$ and $\mathbf{12}_{2b}$ such as described previously with reference to the prior art example of FIG. 1. The conductor discs $\mathbf{12}_{1b}$ and $\mathbf{12}_{2b}$ cross at right angles, with the vertexes of their circular arcs held at the same position and their center lines substantially aligned with each other. The other set of antenna elements is composed of a pair of semicircular arcwise radiators $\mathbf{11}_{1a}$ and $\mathbf{11}_{2a}$, each of which is substantially semicircular and has a cutout defined centrally thereof as described above with reference to FIG. 6. The radiators $\mathbf{11}_{1a}$ and $\mathbf{11}_{2a}$ also cross at right angles, with the vertexes of their circular arcs held at the same position as indicated by 21*a* and their center lines Ox aligned with each other. The two sets of antenna elements are combined, with the vertexes 21*a* and 21*b* of the radiators $\mathbf{11}_{1a}$, $\mathbf{11}_{2a}$ and $\mathbf{12}_{1b}$, $\mathbf{12}_{2b}$ opposed to each other, the vertexes 21*a* and 21*b* being used as feeding points. In this example, the coaxial cable 31 is used for feeding, which has its center conductor connected to the vertex 21*a* and its outer conductor connected to the vertex 21*b*. A twin-lead type feeder or the like can be used in place of the coaxial cable 31.

Figure 1:
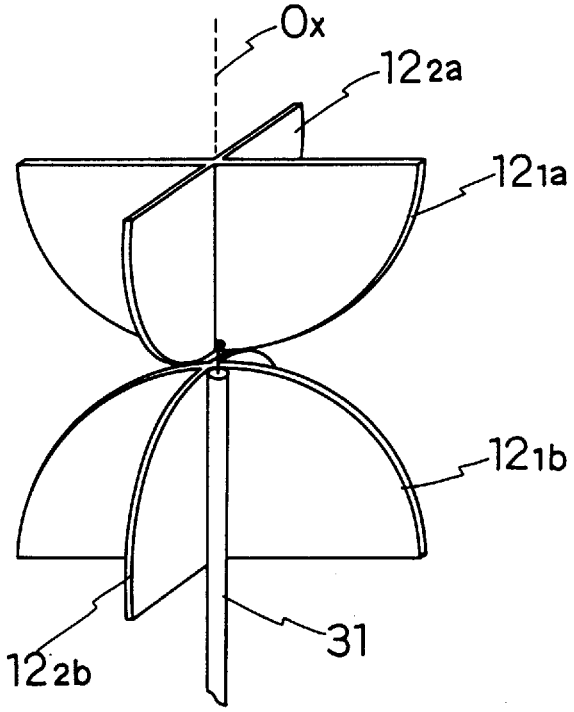
FIG. 1 PRIOR ART
FIG. 1 is a perspective view of a conventional antenna.

The antenna structure of this embodiment also provides the same broadband characteristic as is obtainable with the prior art example of FIG. 1. Accordingly, this embodiment is excellent in space factor as is the case with the first embodiment, and by using a plurality of radiators to form the radiating element, the directivity in the horizontal plane can be made omnidirectional.

THIRD EMBODIMENT

Figure 13:
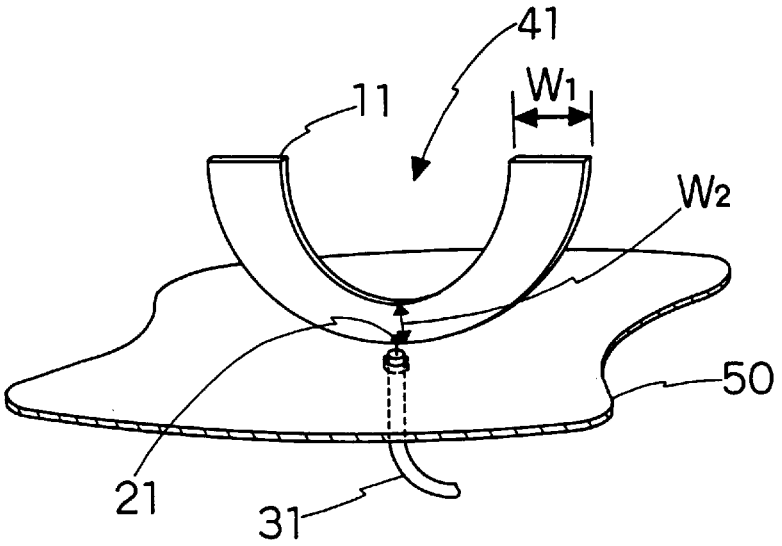
FIG. 13 is a perspective view illustrating a third embodiment of the present invention.

FIG. 13 illustrates in perspective a third embodiment of the present invention, which is a monopole antenna corresponding to the dipole antennas shown in FIGS. 6 and 7. The antenna of this embodiment is composed of a substantially semicircular arcwise radiator 11 having a virtually semicircular cutout 41 defined centrally thereof and a plane conductor ground plate 50. The radiator 11 is disposed with the vertex 21 of its circular arc held in adjacent but spaced relation thereto. The vertex 21 of the radiator 11 is used as a feeding point and the coaxial cable 31 for feeding has its center conductor connected to the vertex 21 of the radiator 11 through a through hole made in the plane conductor ground plate 50 and has its outer conductor connected to the ground plate 50.

Figure 14:
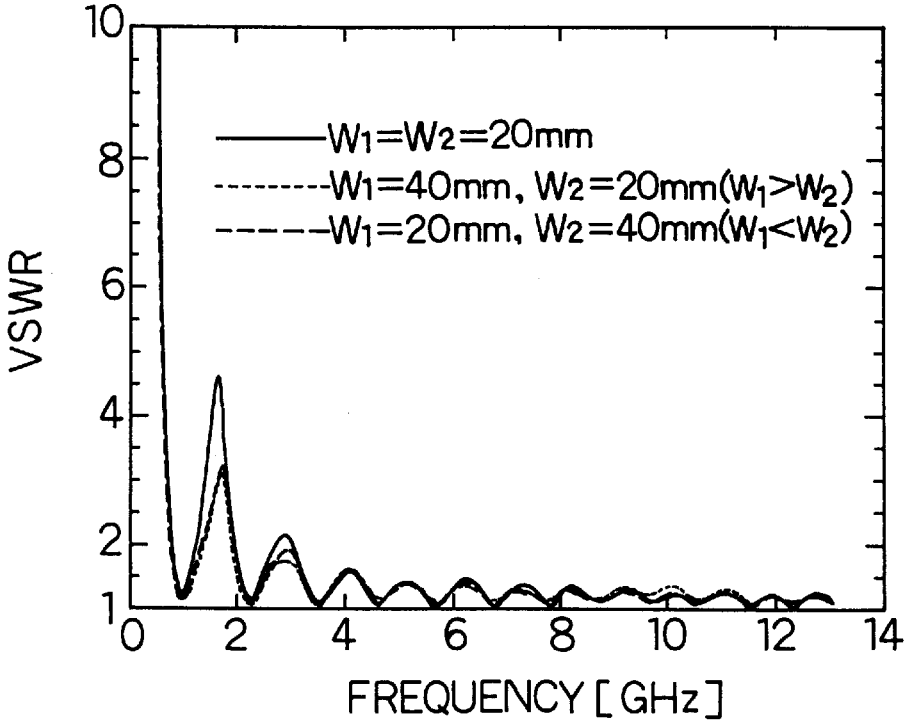
FIG. 14 is a graph showing the VSWR characteristic of the antenna depicted in FIG. 13.

Experiments were conducted on the antenna structure of this embodiment in which the cutout 41 defined centrally of the semicircular arcwise radiator 11 was semi-elliptic. In concrete terms, the experiments were carried out for different values of the width $W_1$ of either end of the radiator 11 and its width $W_2$ at the feeding point 21, i.e. in the cases of $W_1=W_2$, $W_1>W_2$ and $W_1<W_2$. FIG. 14 shows the parameters used in the experiments and the VSWR characteristics measured therefor. No particular change occurred in the VSWR characteristic as a whole although the VSWR value obtained with the arcwise radiator with the semi-elliptic cutout, indicated by the broken line, was lower in the vicinity of 1.5 GHz than in the case of the semicircular cutout,from which its was found that the cutout 41 need not be limited specifically to the semicircular form. The difference in the VSWR value in the neighborhood of 1.5 GHz was due to a difference in the area of the cutout.

FOURTH EMBODIMENT

Figure 15:
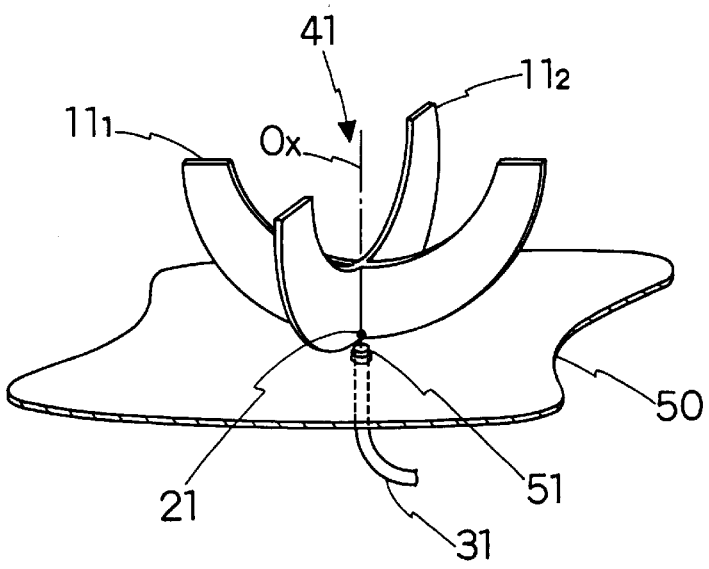
FIG. 15 is a perspective view illustrating a fourth embodiment of the present invention.

FIG. 15 illustrates in perspective a fourth embodiment of the present invention, which employs a pair of semicircular arcwise radiators $\mathbf{11}_1$ and $\mathbf{11}_2$ of exactly the same shape as that of the FIG. 13 embodiment. The radiators $\mathbf{11}_1$ and $\mathbf{11}_2$ cross at right angles with the vertexes of their arcs at the same point and their center lines aligned with each other. That is, the semicircular arcwise radiators $\mathbf{11}_1$ and $\mathbf{11}_2$, each having a cutout 41 defined inside thereof, are combined into one antenna element with the vertexes 21 of their outside shapes held at the same point and their center lines Ox passing therethrough aligned with each other. This antenna element, thus formed by the radiators crossing at right angles, is disposed with its vertex 21 held in adjacent but spaced relation to the plane conductor ground plate 50. The vertex 21 of the antenna element is used as a feeding point, to which the coaxial cable 31 is connected through a through hole made in the plane conductor ground plate 50.

In each of the third and fourth embodiments depicted in FIGS. 13 and 15, an electrical mirror image of the radiator 11 or electrical mirror images of the radiators $\mathbf{11}_1$ and $\mathbf{11}_2$ are formed on the back of the plane conductor ground plate 50. On this account, the size of the radiating element (the radiator 11 or radiators $\mathbf{11}_1$, $\mathbf{11}_2$) is only one-half the size in the first and second embodiments; hence, it is possible to reduce the antenna height by half while realizing the same broadband characteristic as is obtainable with the antenna structures of the first and second embodiments. Thus, an antenna with a good space factor can be implemented by suppressing the antenna height and using the semicircular arcwise radiator having the cutout 41 defined inside thereof.

FIFTH EMBODIMENT

Figure 16:
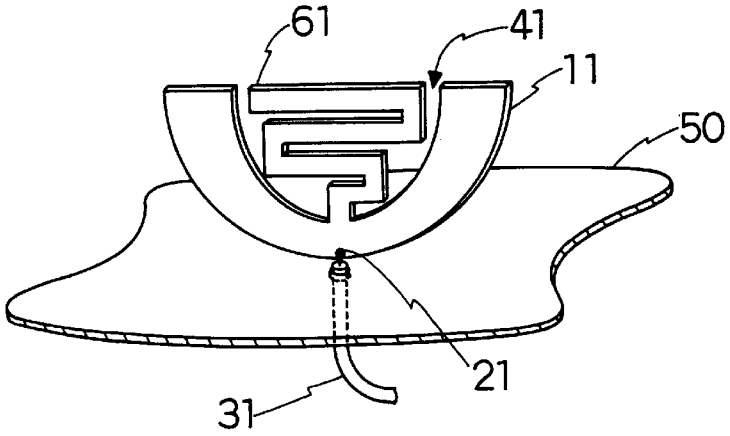
FIG. 16 is a perspective view illustrating a fifth embodiment of the present invention.

FIG. 16 illustrates in perspective a fifth embodiment of the present invention, in which another radiating element of a shape different from the arcwise shape is provided in the cutout 41 defined by the semicircular arcwise radiator of the FIG. 13 embodiment. That is, the antenna of this embodiment comprises the semicircular arcwise radiator 11 with the substantially semicircular cutout 41 defined centrally of its semicircular configuration, the plane conductor ground plate 50 to which the vertex of the semicircular arc of the radiator 11 is held in adjacent but spaced relation, the coaxial cable 31 connected to the feeding point 21 located between the vertex of the radiator 11 and the plane conductor ground plate 50 through a through hole made in the latter, and a meander monopole 61 disposed in the cutout 41 of the radiator 11 with its one end connected to the center of the arcwise radiator 11 closest to the feeding point 21. The coaxial cable 31 has its center conductor connected to the vertex of the radiator 11 through the through hole of the plane conductor ground plate 50 and its outer conductor connected to the ground plate 50. The meander monopole 61 is formed as a unitary structure with the arcwise radiator 11 and power is fed to the former through the latter.

In this embodiment, there is incorporated in the semicircular arcwise antenna 11 the meander monopole antenna 61 whose resonance frequency is lower than the lowest resonance frequency of the arcwise antenna 11. Since the current path of the meander monopole antenna 61 can be made longer than the semicircumference of the semicircular arcwise antenna 11, the meander monopole antenna 61 can resonate at a frequency lower than the lowest resonance frequency of the antenna of each embodiment described above. Thus, the antenna structure with the meander monopole antenna 61 incorporated therein can resonate outside the band of the antenna of each embodiment described above; hence, a multiresonance can be implemented. In particular, by setting the resonance frequency of the meander monopole antenna 61 to be lower than the resonance frequency of the semicircular arcwise radiator 11, the lowest resonance frequency of the antenna can be lowered without the need of changing the antenna size.

SIXTH EMBODIMENT

Figure 17:
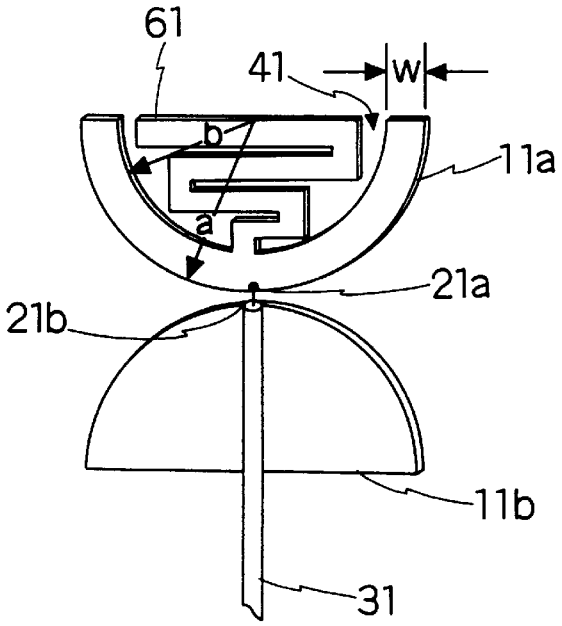
FIG. 17 is a perspective view illustrating a sixth embodiment of the present invention.
Figure 18:
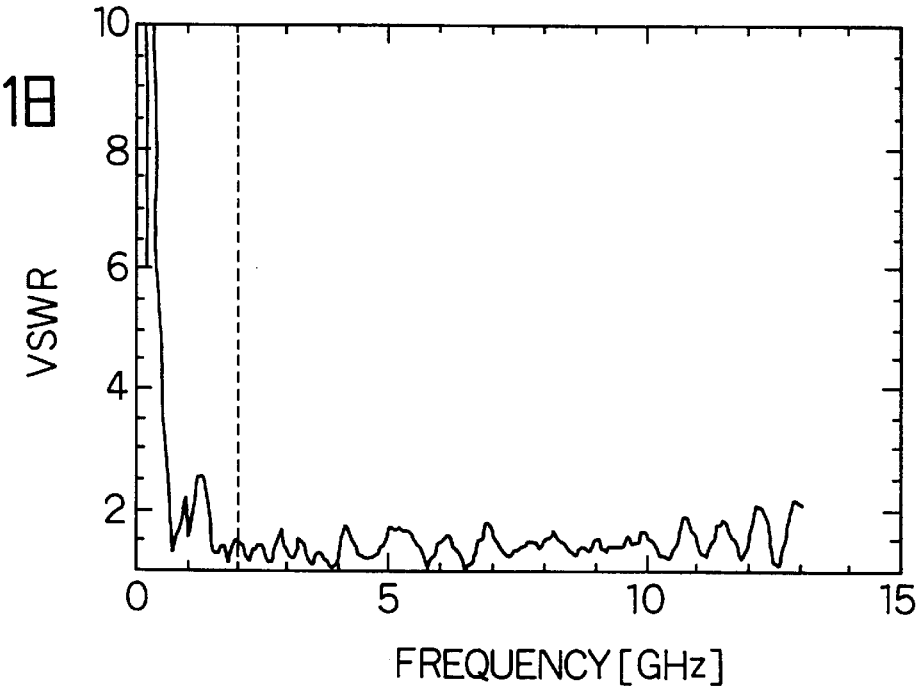
FIG. 18 is a graph showing the VSWR characteristic of the antenna depicted in FIG. 17.
Figure 19:
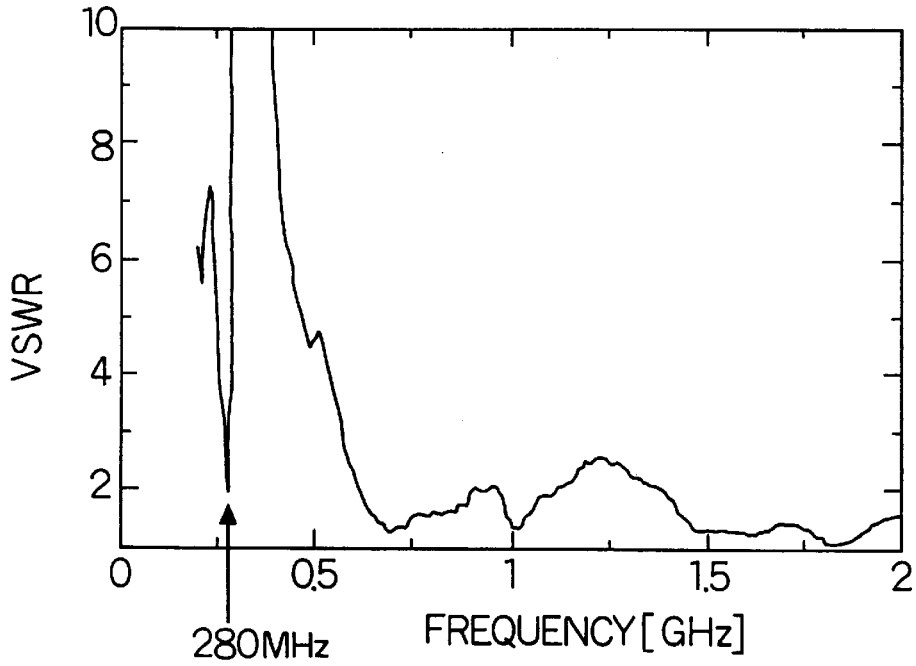
FIG. 19 is a graph showing the low-frequency region on an enlarged scale in FIG. 18.

FIG. 17 illustrates in perspective a sixth embodiment of the present invention and FIGS. 18 and 19 show its measured VSWR characteristic.

Figure 2:
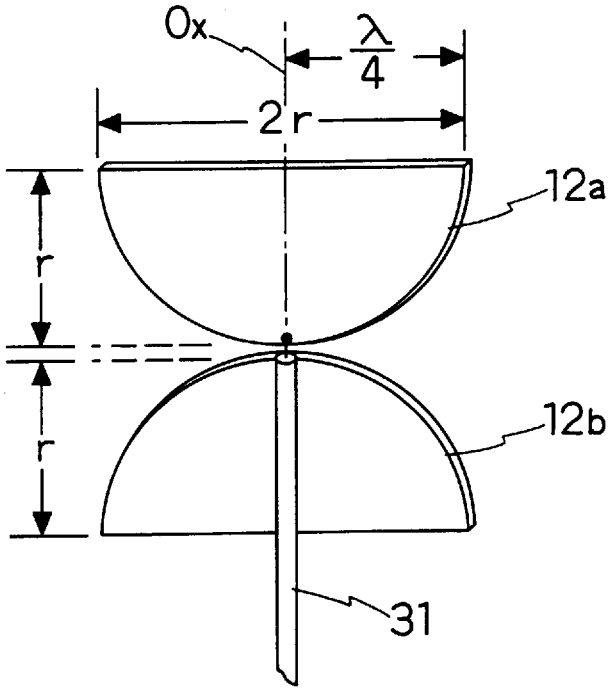
FIG. 2 PRIOR ART
FIG. 2 is a perspective view showing a simplified version of the antenna of FIG. 1.

The antenna of this embodiment differs from the FIG. 16 embodiment in that a semicircular radiator 11*b*, such as in the FIG. 2 prior art example, is provided as a dipole antenna in place of the plane conductor ground plate 50. That is, the antenna is provided with the substantially semicircular arcwise radiator 11*a* and the semicircular radiator 11*b*, which are disposed with the vertexes 21*a* and 21*b* of their arcs opposed to each other as feeding points. The coaxial cable 31 is connected to these feeding points. The meander monopole antenna 61 is placed in the cutout 41 of the radiator 11*a* and its lower end is connected to the center of the inner marginal edge of the latter. The coaxial cable 31 has its center conductor connected to the vertex 21*a* of the arcwise radiator 11*a* and its outer conductor connected to the semicircular radiator 11*b*. The power feed to the meander monopole antenna 61 is effected through the radiator 11*a*.

The VSWR characteristic of this antenna was measured. The outside shape of the semicircular arcwise radiator 11*a* had a radius r of 75 mm, the semicircular cutout 41 was concentric with the outside shape of the radiator 11*a* and had a radius b of 55 mm, and the width w of the radiator 11*a* was 20 mm. The resonance frequency of the meander monopole antenna 61 was adjusted to be 280 MHz. FIG. 18 shows the measured VSWR characteristic over the entire band and FIG. 19 shows the characteristic over the band from zero to 2 GHz on an enlarged scale. These graphs differ in the scale of frequency on the abscissa but show measured data of the same antenna.

From FIG. 18 it is seen that the antenna of this embodiment has the same characteristics as those of the conventional antenna in terms of band and VSWR. From FIG. 19 it is seen that the meander monopole 61 enables the antenna of this embodiment to resonate at 280 MHz as well. The measured results indicate that the antenna structure of this embodiment implements multiresonance without changing the size of the antenna and permits lowering of the lowest resonance frequency.

Figure 20:
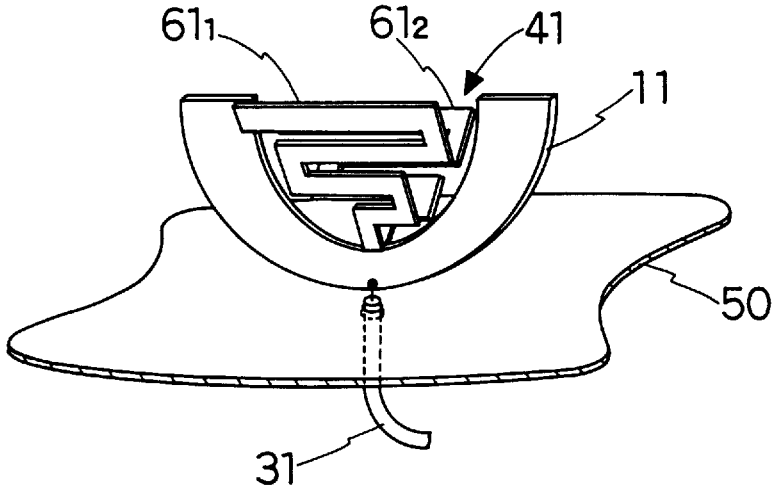
FIG. 20 is a diagram illustrating a modified form of the FIG. 16 embodiment.
Figure 21:
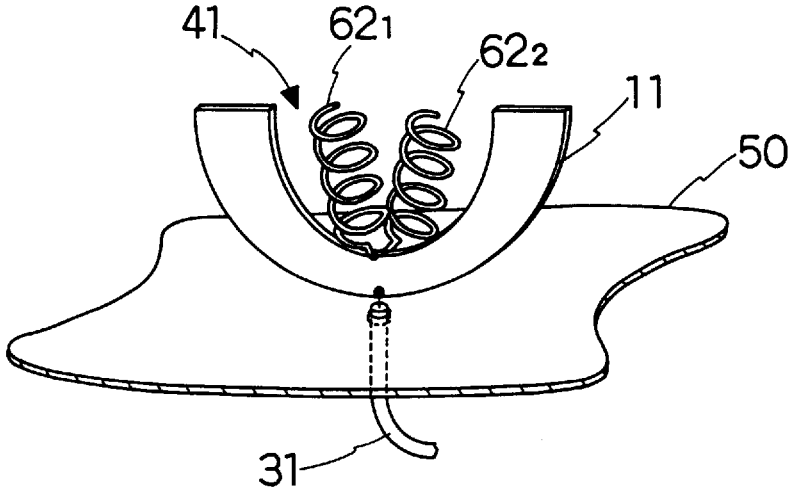
FIG. 21 is a diagram illustrating another modification of the FIG. 16 embodiment.
Figure 22:
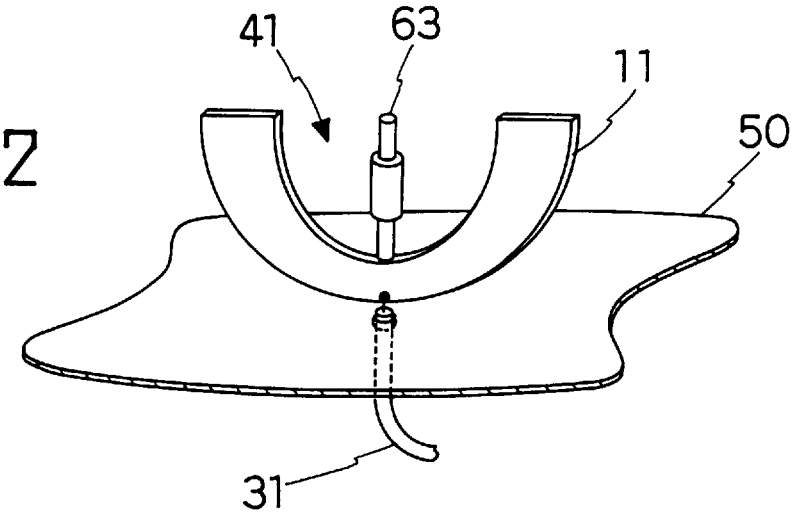
FIG. 22 is a diagram illustrating still another modification of the FIG. 16 embodiment.

FIGS. 20 through 22 illustrate modified forms of the FIG. 16 embodiment, which have two meander monopoles $\mathbf{61}_1$ and $\mathbf{61}_2$, two helical antennas $\mathbf{62}_1$ and $\mathbf{62}_2$ and one resistance-loaded monopole 63 incorporated in the semicircular cutout 41 defined by the semicircular arcwise radiator 11, respectively. The radiating elements to be incorporated in the cutout 41 need not be limited specifically to those of the above-mentioned shapes but radiating elements of other forms may also be used so long as they can be accommodated in the semicircular cutout 41. While in FIGS. 20 and 21 two radiating elements are shown to be provided in the cutout 41, a desired number of radiating elements can be used. The power is fed to the incorporated radiating elements via the radiator 11.

In the case of incorporating a plurality of radiating elements in the cutout 41 defined by the arcwise radiator 11 as shown in FIG. 20 or 21, it is possible to increase the number of resonance frequencies by making the resonance frequencies of the radiating elements different. By using a broadband antenna such as a resistance-loaded monopole 63 shown in FIG. 22 and by setting its resonance frequency to be lower than that of the semicircular arcwise conductor monopole formed by the radiator 11, it is possible to lower the lowest resonance frequency without upsizing the antenna structure and hence further increase the bandwidth.

SEVENTH EMBODIMENT

In each of the embodiments described above at least one semicircular arcwise radiator has the smaller semicircular cutout 41 defined concentrically therewith to form a space in which to accommodate another antenna element or circuit element. A description will be given of embodiments in which at least one substantially semicircular radiator is wound one turn into a cylindrical shape to reduce the transverse length of the antenna.

Figure 23:
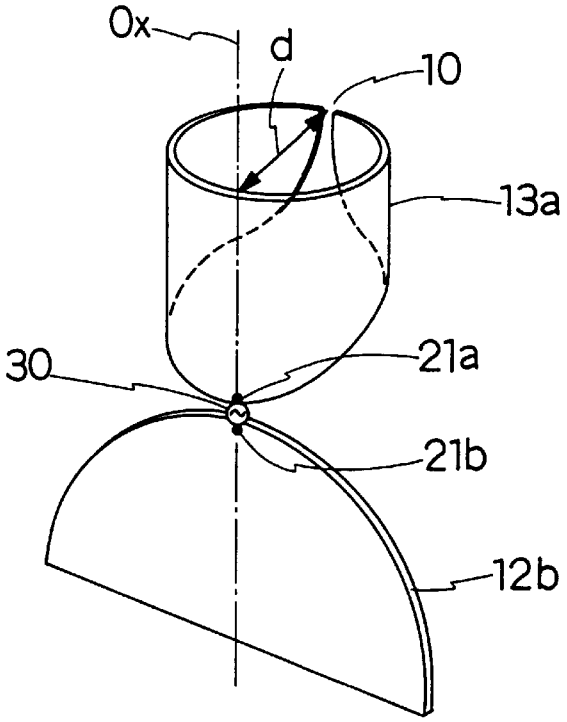
FIG. 23 is a perspective view illustrating one mode of carrying out the sixth embodiment of the present invention.

FIG. 23 is a perspective view illustrating the antenna structure of a seventh embodiment of the present invention, which is provided with a radiator 13*a* formed by winding a substantially semicircular conductor disc one turn into a cylindrical shape so that its straight side forms substantially a circle, and a radiator 12*b* formed by a semicircular conductor disc. The radiators 13*a* and 12*b* are disposed with the center line Ox held in common thereto and the vertexes 21*a* and 21*b* of their circular arcs opposed to each other. The vertexes 21*a* and 21*b* are used as feeding points and the feeding section 30 is provided between them.

Figure 24:
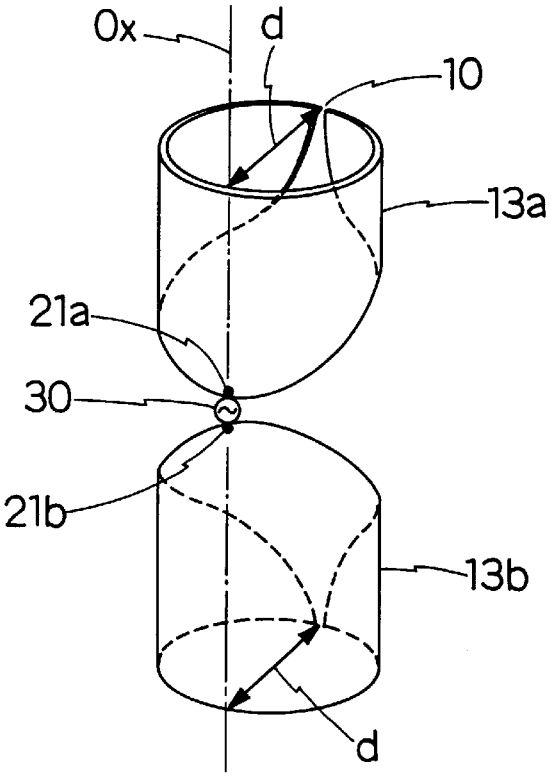
FIG. 24 is a perspective view illustrating another mode of carrying out the sixth embodiment of the present invention.

FIG. 24 illustrates in perspective a modified form of the FIG. 13 embodiment, which is provided with radiators 13*a* and 13*b* each formed by winding a semicircular conductor disc one turn around a common column whose generating line is the center line (the radius of the semicircle) Ox passing through the vertex of each semicircular conductor disc. The radiators 13*a* and 13*b* are disposed with the vertexes 21*a* and 21*b* of their circular arcs opposed to each other. That is, the two semicircular radiators are each cylindrical with its straight side forming a circle.

As described above, one of the two radiators forming the antenna may be such a cylindrical radiator 13*a* as shown in FIG. 23, or both radiators may be such cylindrical radiators 13*a* and 13*b* as shown in FIG. 24. In either case, the VSWR characteristic remains essentially unchanged regardless of whether or not the opposite ends of the curved radiator 13*a* (FIG. 23) or radiators 13*a* and 13*b* (FIG. 24) in their circumferential direction are held in contact with each other, as described later on.

In the embodiments of FIGS. 23 and 24, the opposite ends of the cylindrical radiator 13*a* (also 13*b* in FIG. 24) in the circumferential direction thereof are separated by a small gap 10. It is preferable that a straight line d joining the center line Ox of the cylindrical radiator 13*a* and the center of the gap 10 be approximately at right angles to the former. In FIG. 24 it is desirable that straight lines d joining the center line Ox common to the radiators 13*a* and 13*b* and the centers of respective gaps 10 be substantially parallel to each other. The radiators 13*a* and 13*b* may preferably be of the same size in their original semicircular shape. The shape of the radiator 13*a* or 13*b* may be elliptic-cylindrical as well as cylindrical, that is, the radiator needs only to be substantially cylindrical.

With the use of such a cylindrical radiator, the transverse width that is occupied by at least one radiating element is reduced down to about ⅓ that needed in the prior art example using a flat radiator, and hence the space factor can be increased accordingly.

Figure 25:
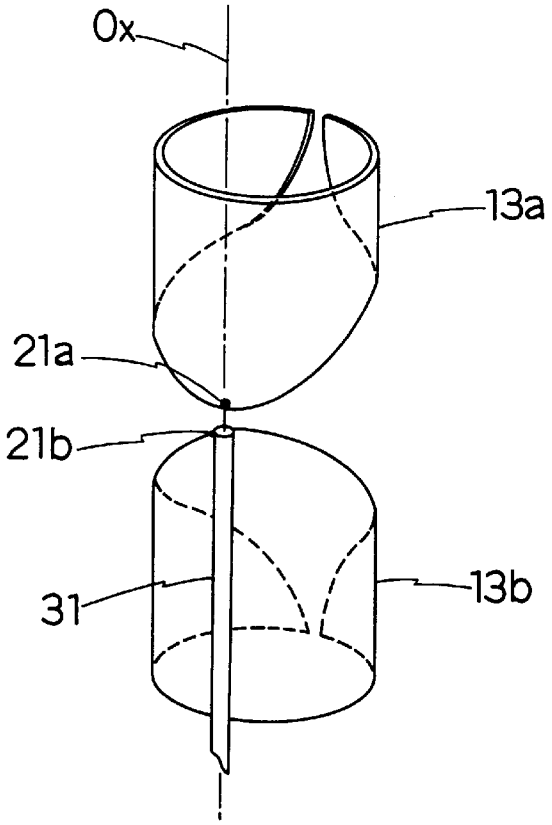
FIG. 25 is a perspective view illustrating an example of the structure for feeding in the present invention.
Figure 26:
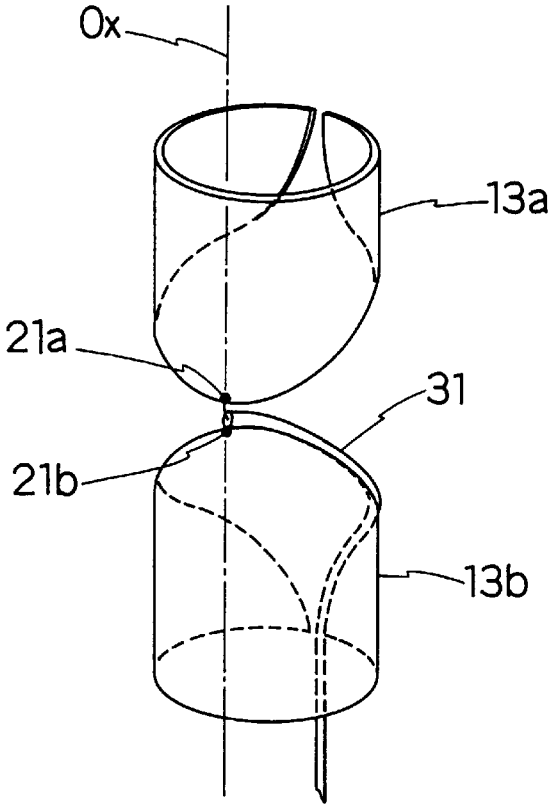
FIG. 26 is a perspective view illustrating another example of the structure for feeding.
Figure 27:
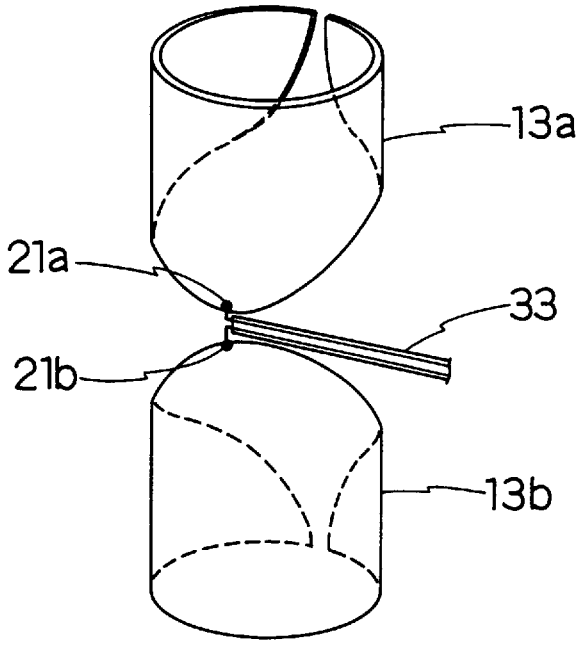
FIG. 27 is a perspective view illustrating still another example of the structure for feeding.

FIGS. 25 through 27 show, by way of example, feeding schemes for the antenna of FIG. 24. In FIG. 25 the coaxial cable 31 is arranged along the center line Ox passing through the vertex of the radiator 13*b*, whereas in FIG. 26 the coaxial cable 31 is arranged along the semicircular arc of the radiator 13*b*. In FIG. 27 a twin-lead type feeder 33 is placed between the radiators 13*a* and 13*b*. In any case, the vertexes 21 and 21*b* of the two radiators 13*a* and 12*b* (or 13*a* and 13*b*) are used as feeding points thereto.

EIGHTH EMBODIMENT

Figure 28:
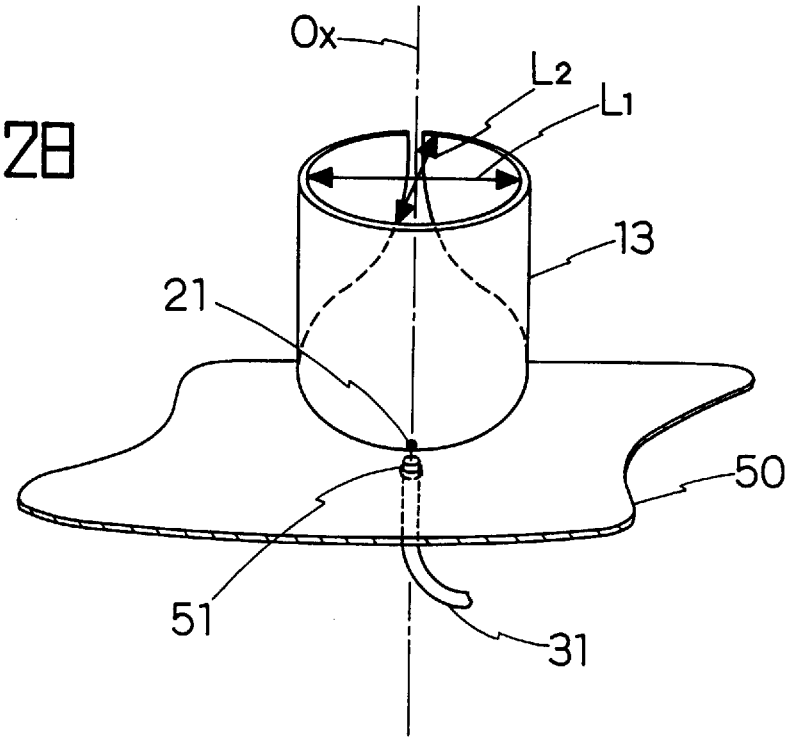
FIG. 28 is a perspective view of a seventh embodiment of the present invention.

FIG. 28 is a perspective view illustrating an eighth embodiment of the present invention, which constitutes a monopole antenna by using the plane conductor ground plate 50 as in the FIG. 13 embodiment instead of using the radiator 12*b* or 13*b* in the embodiments of FIGS. 23, 24 and 25. That is, the antenna of this embodiment comprises a radiator 13 formed by bending a substantially semicircular conductor disc into a cylindrical shape so that the center line Ox passing through the vertex of the semicircular arc is parallel to the center axis of the cylindrical shape, and the plane conductor ground plate 50 placed adjacent the vertex 21 of the circular arc of the radiator 13 substantially at right angles to the center line Ox passing through the vertex 21. The vertex 21 of the radiator 13 is used as a feeding point and power is fed via the coaxial cable 31 passing through a through hole 51 made in the plane conductor ground plate 50; namely, the coaxial cable 31 has its center conductor connected to the vertex 21 of the radiator 13 and its outer conductor connected to the plane conductor ground plate 50.

In this embodiment an electrical mirror image of the radiating element 13 is formed by the plane conductor ground plate 50 on the reverse side thereof. Accordingly, this embodiment requires only one radiating element, one-half the number of those used in the seventh embodiment (FIGS. 23 to 27), and hence permits reduction of the antenna height by half although it implements the same broadband characteristic as is obtainable with the seventh embodiment. Thus, the antenna of this embodiment is excellent in the space factor with a small antenna height.

Figure 29A:
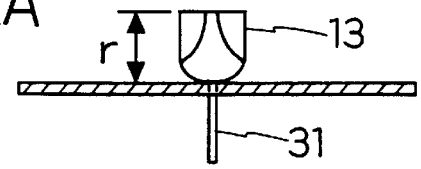
FIG. 29A is a front view of an antenna used for experiments of the seventh embodiment of the present invention.
Figure 29B:
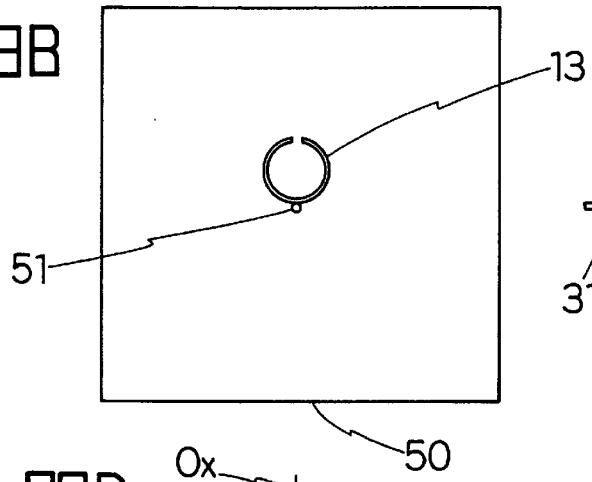
FIG. 29B is its plan view.
Figure 29C:
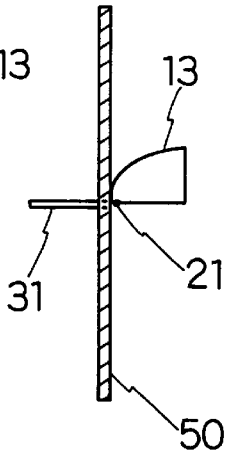
FIG. 29C is its right-hand side view.
Figure 29D:
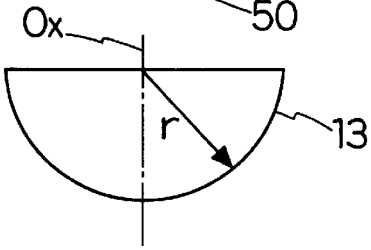
FIG. 29D is a development of a radiator 13.

An experiment was carried out to confirm the performance of the antenna of this embodiment. FIGS. 29A, 29B and 29C are front, plan and right-hand side views of the antenna used in the experiment, and FIG. 29D is a development of the radiator 13 used. The radiator 13 was obtained by winding a semicircular conductor disc of a 75 mm radius r, shown in FIG. 29D, one turn around a 50 mm diameter column having its generating line defined by the center line Ox passing through the semicircular arc. The plane conductor ground plate 50 used was a 300 mm by 300 mm sheet of copper 0.2 mm thick. The power was fed via the feeding cable 31 passed through the through hole 51 made in the plane conductor ground plate centrally thereof. The coaxial cable 31 had its center conductor connected to the vertex 21 of the radiator 13 (FIG. 29C) and its outer conductor connected to the plane conductor ground plate 50.

Figure 30:
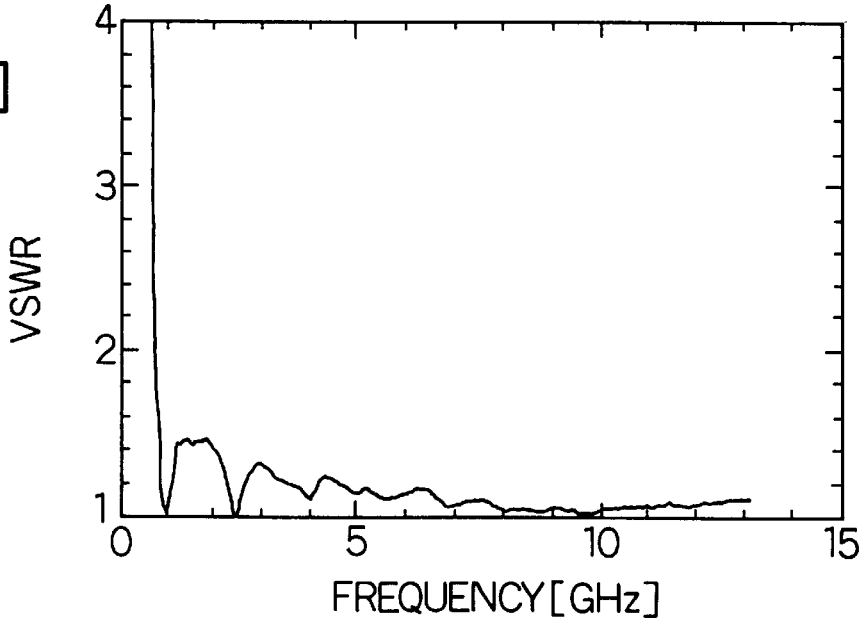
FIG. 30 is a graph showing the measured VSWR characteristic of the antenna of FIGS. 29A to 29D.

In FIG. 30 there is shown the VSWR characteristic measured in the experiment. Comparison of the measured VSWR characteristic with that of the prior art example shown in FIG. 3 indicates that the antenna of this embodiment has the same broadband characteristic as that of the prior art example and that the VSWR values are smaller than those of the prior art over the entire band. That is, the VSWR characteristic of this antenna is improved in comparison with that of the prior art. With such a combined use of the cylindrical radiator and the plane conductor ground plate, the antenna of this embodiment has an excellent space factor in that the antenna height is reduced by half and the antenna width occupied by the radiator is one-third that of the prior art, besides the VSWR characteristic is also enhanced as compared with that of the prior art example.

While in the embodiments of FIGS. 23 through 28 the radiator 13 is shown to be regular cylindrical in shape, it may also be elliptic-cylindrical. Let two axes of the elliptic-cylindrical radiator 13 be represented by an axis L2 crossing the center line Ox at right angles and an axis L1 crossing that L2 at right angles as shown in FIG. 28. The VSWR characteristic was measured under the three conditions listed below.

(1) L1=L2=50 (cylindrical)

(b) L1=33 mm, L2=60 mm (an elliptic cylinder with L1>L2)

(3) L1=60 mm, L2=33 mm (an elliptic cylinder with L1<L2)

Figure 31:
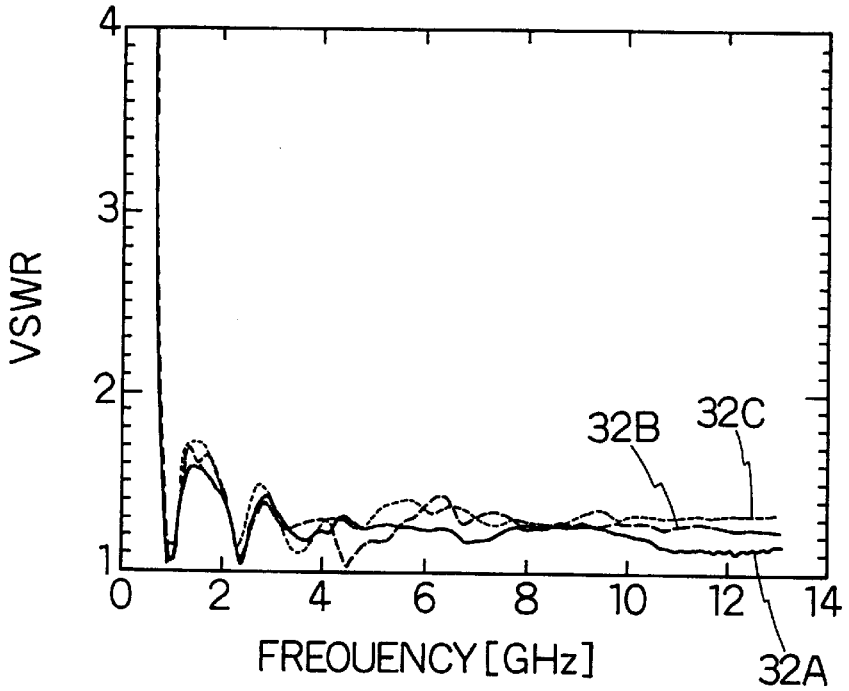
FIG. 31 is a graph showing the VSWR characteristics measured for different axial lengths of the elliptic cylindrical radiator in FIG. 28.

In FIG. 31 there are shown the VSWR characteristics measured under the above-mentioned conditions, which are indicated by the solid, dotted and broken lines 31A, 31B and 31C, respectively. As is evident from FIG. 31, the VSWR characteristic does not undergo any significant change even if the radiator 13 is elliptic-cylindrical in shape; hence, the radiator 13 need not always be cylindrical in shape but may also be elliptic-cylindrical in the range of the axis ratio L1/L2 from about 0.5 to 1.5. This applies to all the embodiments described later on and to either of the radiators 13*a* and 13*b*.

Figure 32:
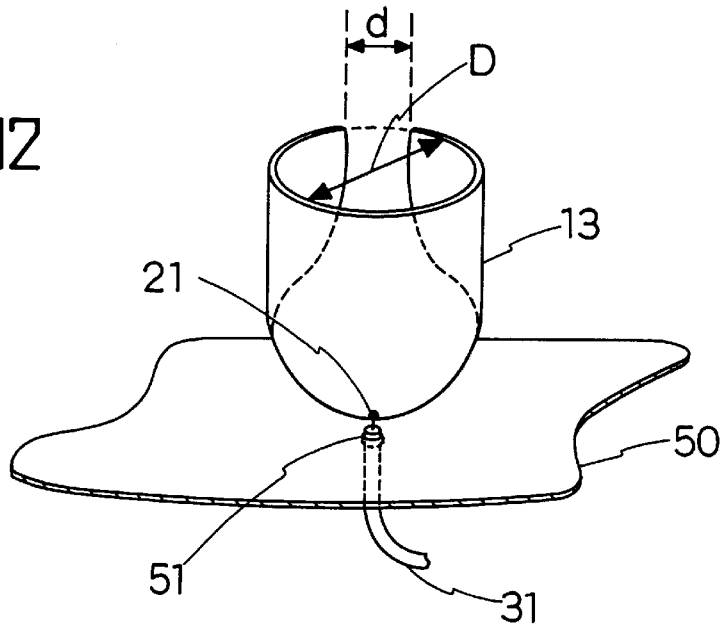
FIG. 32 is a diagram for explaining the distance between opposite ends of a semicircular radiator bent into a cylindrical form.
Figure 33:
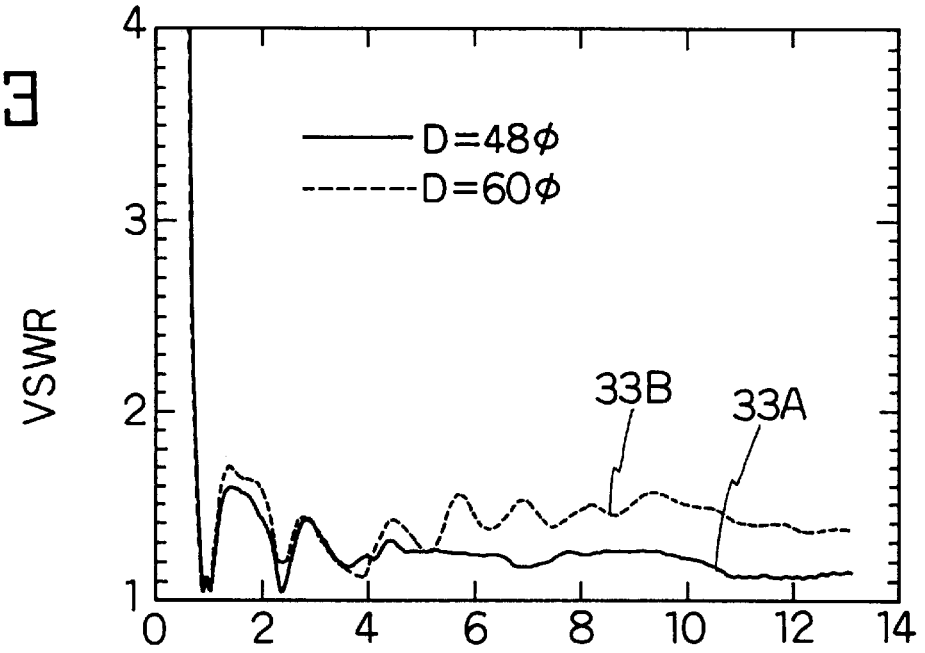
FIG. 33 is a graph showing the VSWR characteristics measured for different distances between the opposite ends of the cylindrical radiator by changing the diameter of its cylindrical form.

Although in the embodiments of FIGS. 23 through 28 the cylindrical radiator 13 is shown to have its opposite ends held substantially in contact with each other, the opposite ends may also be separated by a gap d as shown in FIG. 32. FIG. 33 shows the VSWR characteristics measured when the diameter D of the cylindrical radiator 13 was 48 mm (the gap d was 1 mm) and 37 mm (the gap d was 6 mm), the measured characteristics being indicated by the solid line 33A and the broken line 33B, respectively. The broadband characteristic of the antenna is retained also when the opposite ends of the cylindrical radiator 13 are held out of contact with each other. As the gap d increases, the VSWR characteristic becomes degraded but even so, it is more excellent than in the prior art.

Figure 34:
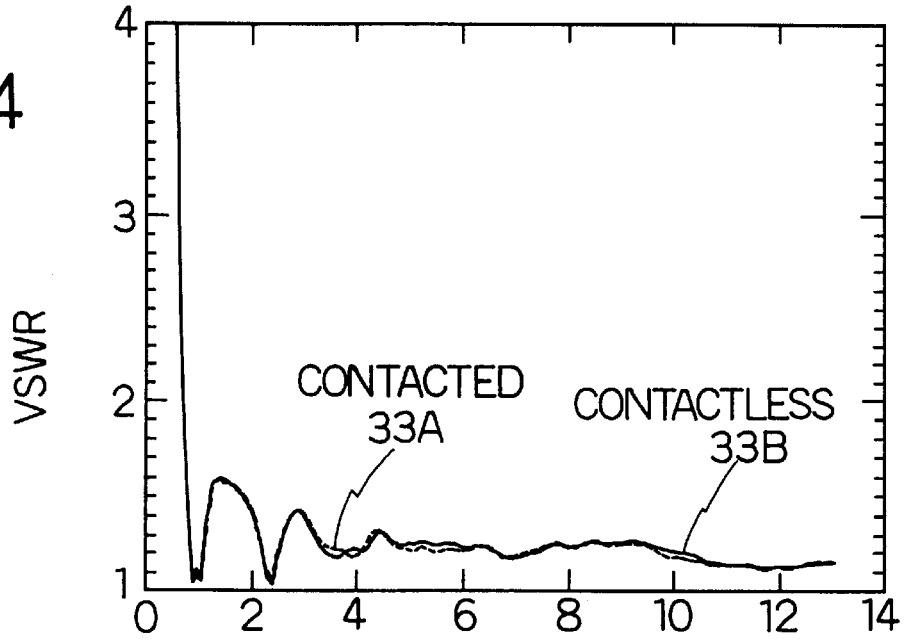
FIG. 34 is a graph showing the VSWR characteristics measured in the cases where the opposite ends of the semicircular radiator are electrically connected and isolated, respectively.

In FIG. 34 there are indicated by the broken line 34A and the solid line 34B, respectively, VSWR characteristics measured in the cases where the opposite ends of the radiator 13 were soldered to each other (d=0) and where the opposite ends were slightly held (around 1 mm) apart. As is evident from FIG. 34, the VSWR characteristic remains substantially unchanged irrespective of whether the opposite ends of the cylindrical radiator 13 are in contact with each other or not. Hence, the opposite ends need not always be held in contact. This applies to all the other embodiments of the present invention.

NINTH EMBODIMENT

Figure 35:
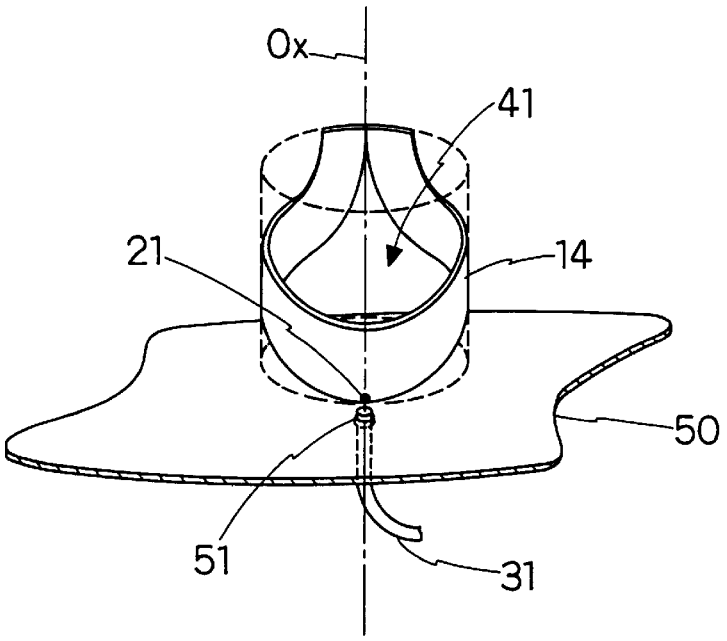
FIG. 35 is a perspective view illustrating an eighth embodiment of the present invention.

FIG. 35 is a perspective view illustrating an antenna structure according to a ninth embodiment of the present invention. The antenna of this embodiment uses a semicircular arcwise radiator 14 with a virtually semicircular cutout 41 defined centrally thereof, which is obtained by winding a semicircular arcwise conductor (see FIG. 36D) one turn around a column whose generating line is defined by the center line Ox passing through the vertex of the semicircular arc of the semicircular arcwise conductor. That is, the radiator 14 is formed by the semicircular arcwise marginal portion of the radiator 13 depicted in FIG. 29D. As is the case with FIG. 28, the plane conductor ground plate 50 is disposed adjacent the vertex 21 of the circular arc of the radiator 14.

The vertex 21 of the radiator 14 is used as the feeding point, to which power is fed from the coaxial cable 31 passed through the through hole 51 made in the plane conductor ground plate 50. The center conductor of the coaxial cable 31 is connected to the feeding point 21 of the radiator 14 and its outer conductor to the plane conductor ground plate 50. With the provision of the cutout 41 defined by the semicircular arcwise radiator 14, the space efficiency can be increased higher than in the case of the seventh or eighth embodiment which uses the radiator formed by merely winding a semicircular conductor disc into a cylindrical shape with no cutout. As referred to previously with respect to FIG. 5A, the antenna current in the semicircular radiating element is mostly distributed along the lower marginal edge of its semicircular arc and no antenna current flows along the upper straight side and in the central portion of the semicircular radiating element; that is, only the lower semicircular arcwise marginal portion contributes to the radiation of radio waves, and hence the cutout 41 does not affect the antenna operation. The cutout 41 need not always be semicircular (in the state of the radiator being developed) in shape but may also be semi-elliptic, for instance.

Figure 36A:
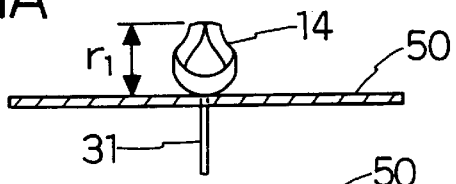
FIG. 36A is a front view of an antenna used for experiments of the eighth embodiment of the present invention.
Figure 36B:
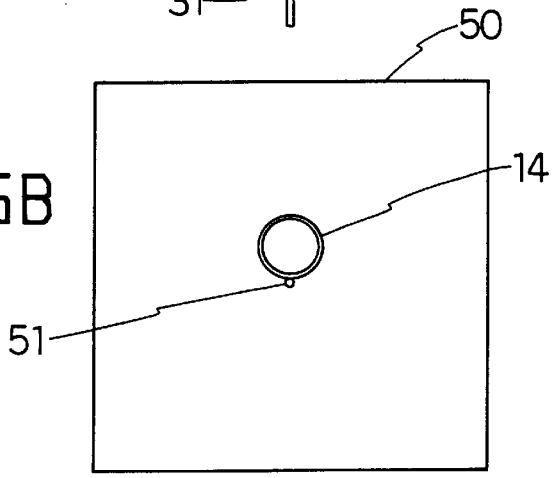
FIG. 36B is its plan view.
Figure 36C:
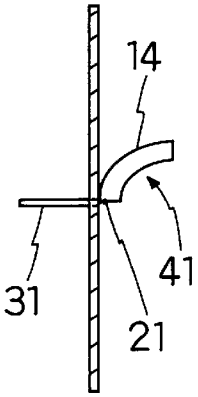
FIG. 36C is its right-hand side view.
Figure 36D:
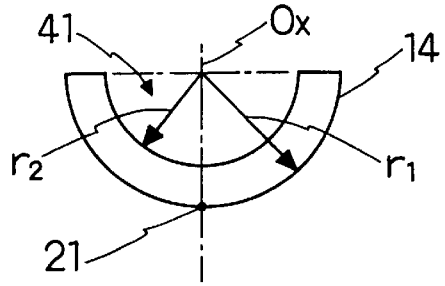
FIG. 36D is a development of a radiator 14.
Figure 37A:
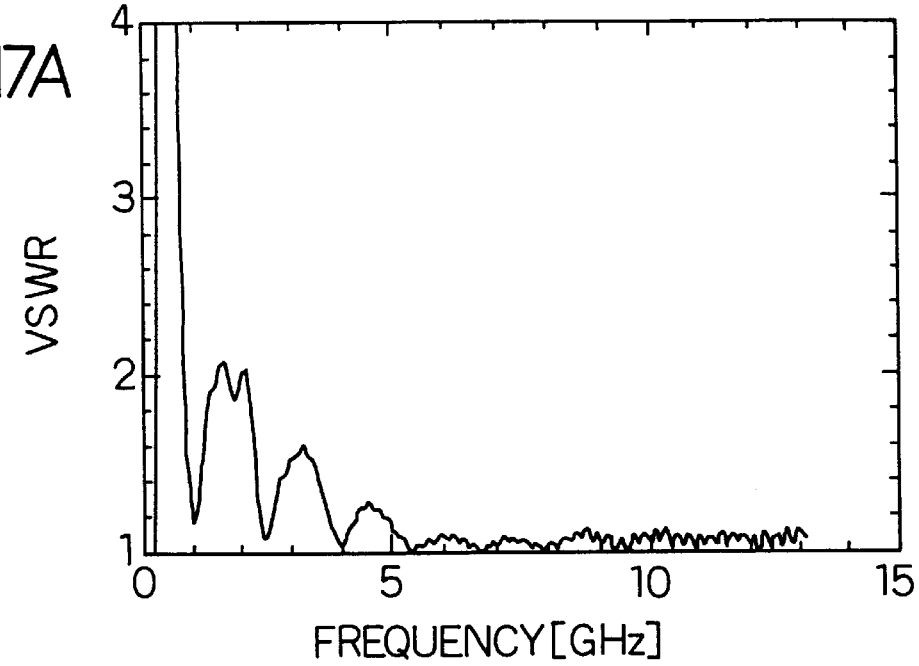
FIG. 37A is a graph showing the VSWR characteristic of the antenna of FIGS. 36A to 36D.

An experiment was conducted to confirm the performance of this antenna. FIGS. 36A, 36B and 36C are front, plan and right-hand side views of the antenna, and FIG. 36D is a development of the radiator 14. In FIG. 37A there is shown the VSWP characteristic measured in the experiment. To obtain the radiator 14, a semicircular arcwise conductor plate of a 75 mm radius $r_1$ with the semicircular cutout 41 of a 55 mm radius $r_2$ defined concentrically with the outside shape of the arcwise conductor plate was wound one turn around a 50 mm diameter column whose generating line was defined by the center line Ox passing through the vertex 21 of the semicircular arcwise conductor. The plane conductor ground plate 50 used was a 300 mm by 300 mm sheet of copper 0.2 mm thick. The power was fed via the feeding cable 31 passed through the through hole 51 made in the plane conductor ground plate 50 centrally thereof. The coaxial cable 31 had its center conductor connected to the vertex 21 of the radiator 14 and its outer conductor connected to the plane conductor ground plate 50.

When the VSWR characteristic obtained in the experiment (FIG. 37A) is compared with the VSWR characteristic (FIG. 30) of the antenna of FIG. 29 without the cutout 41, it is seen that the broadband characteristic is the same as in the prior art even if the radiator has the cutout 41. In this instance, the VSWR is degraded in the band below 5 GHz, but when compared with the characteristic of the prior art shown in FIG. 3, the VSWR characteristic is not degraded in the low-frequency region and the VSWR is improved markedly in the high-frequency band. With the provision of the cutout 41 defined by the radiator 14, another antenna element can be placed in the cutout 41; hence, the antenna of this embodiment is excellent in terms of space factor.

Figure 37B:
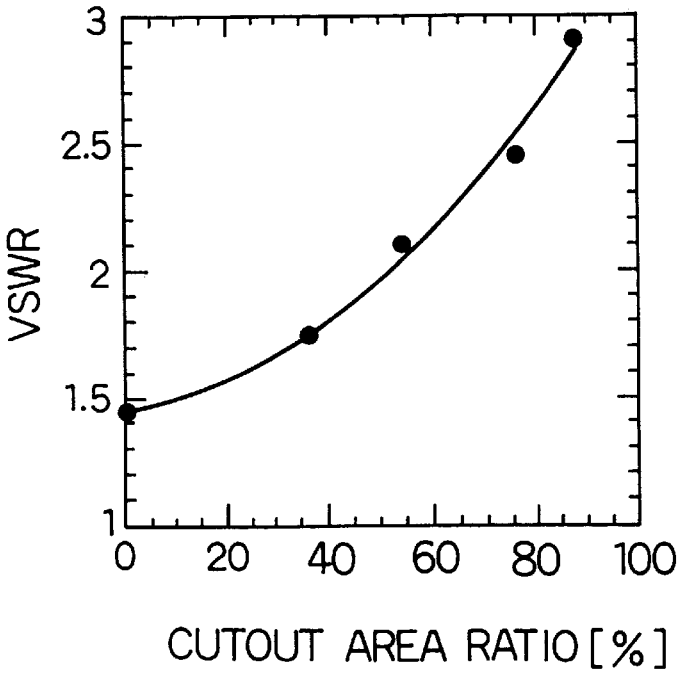
FIG. 37B is a graph showing, by way of example, the relationship between the area ratio of a cutout to the radiator and the worst VSWR characteristic in the operating region.

FIG. 37B is a graph showing the relationship between the area ratio of the semicircular cutout 41 to the semicircular arcwise radiator 14 and the worst VSWR in the operating band. From FIG. 37B it is seen that when the VSWR is allowed in the range to 2, the cutout 41 can be increased up to about 50% in terms of the above-mentioned area ratio. This is approximately 0.7 in terms of the radius ratio r2/r1, indicating that the cutout 41 can be made appreciably large.

TENTH EMBODIMENT

Figure 38:
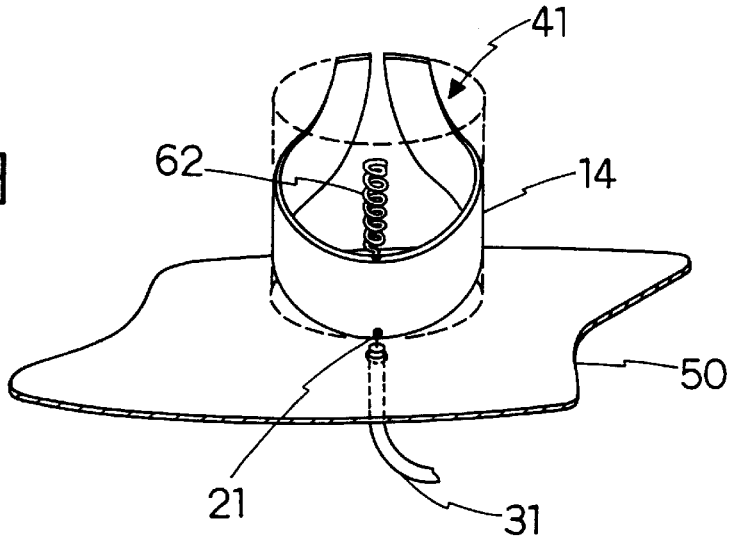
FIG. 38 is a perspective view illustrating a ninth embodiment of the present invention.

FIG. 38 is a perspective view illustrating an antenna structure according to a tenth embodiment of the present invention, which uses the same semicircular arcwise radiator 14 as that used in the ninth embodiment of FIG. 35 but differs therefrom in that a radiating element is placed in the cutout 41 defined by the radiator 14. The plane conductor ground plate 50 is disposed adjacent the vertex 21 of the semicircular arc of the radiator 14. Placed in the cutout 41 defined by the semicircular arcwise radiator 14 is a helical antenna 62, which is positioned above the vertex 21 with its axis held substantially vertical to the plane conductor ground plate 50. The coaxial cable 31 is passed through the through hole 51 of the plane conductor ground plate 50 and has its center conductor connected to the vertex 21 of the radiator 14 and its outer conductor connected to the plane conductor ground plate 50. The helical antenna 62 is supplied with power via the radiator 14.

In this embodiment, the helical antenna is incorporated as a second antenna in the antenna structure of FIG. 35. The band of the second antenna is arbitrary, but by selecting the second antenna whose operating band is lower than the lowest resonance frequency of the counterpart, multiresonance could be implemented. Further, by selecting the second antenna of a size that can be accommodated in the cutout 41, the lowest resonance frequency could be reduced without increasing the size of the entire antenna structure.

Figure 39A:
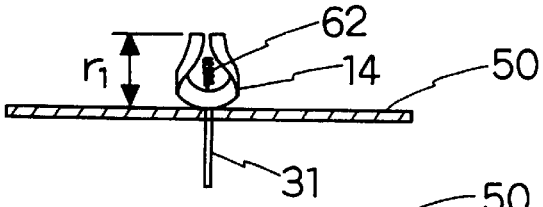
FIG. 39A is a front view of an antenna used for experiments of a tenth embodiment of the present invention.
Figure 39B:
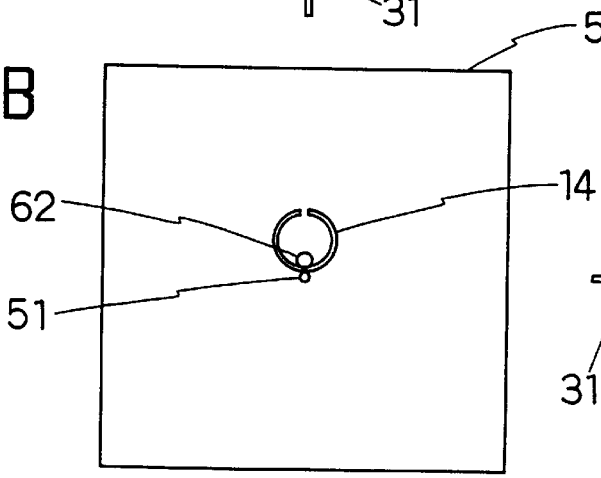
FIG. 39B is its plan view.
Figure 39C:
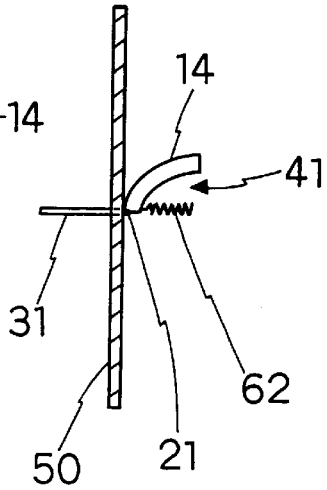
FIG. 39C is its right-hand side view.
Figure 39D:
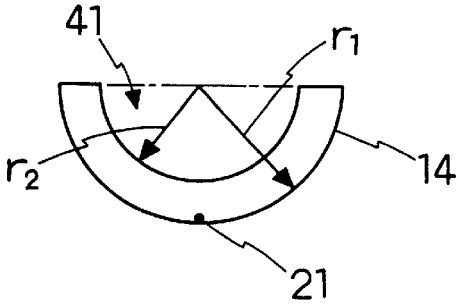
FIG. 39D is a development of radiator 14.
Figure 40:
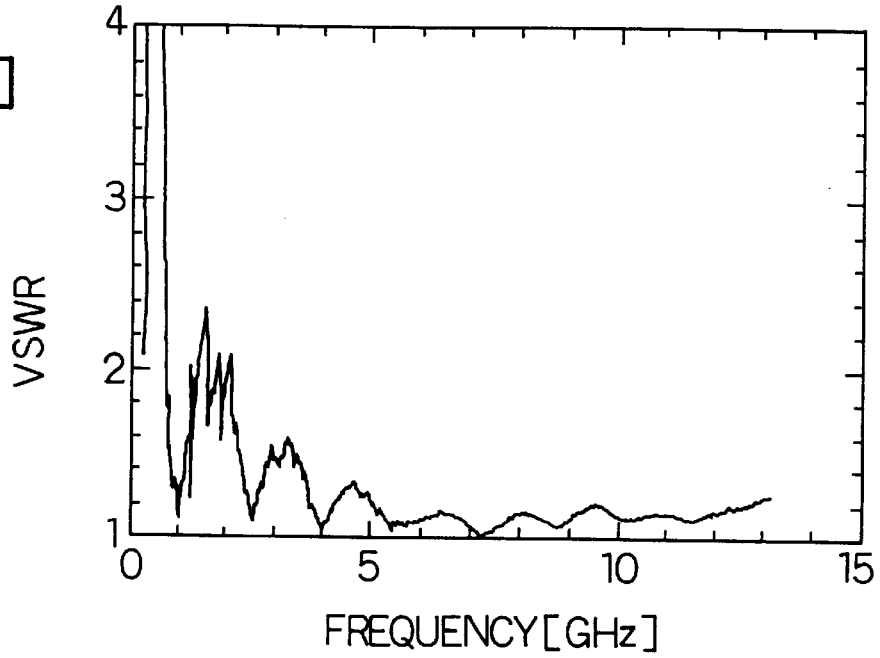
FIG. 40 is a graph showing the measured VSWR characteristic of FIGS. 39A to 39D.
Figure 41:
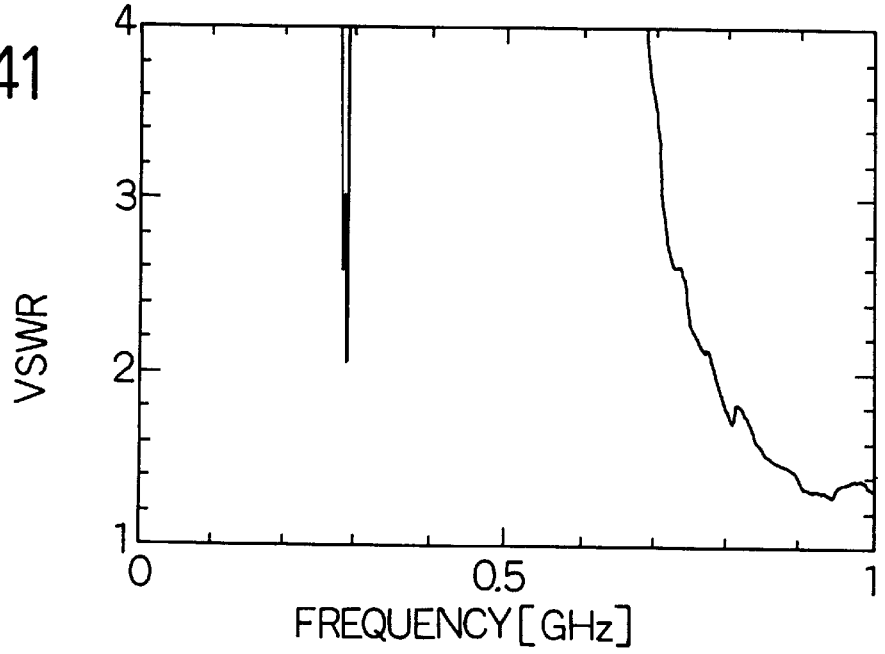
FIG. 41 is a graph showing the low-frequency region on an enlarged scale in FIG. 40.

An experiment was made to confirm the performance of the antenna of this embodiment. FIGS. 39A, 39B and 39C are front, plan and right-hand side views of the antenna and FIG. 39D is a development of the radiator 14. In FIGS. 40 and 41 there are shown the measured VSWR characteristic. FIG. 41 is a graph showing the VSWR characteristic over the frequency band 0 to 1 GHz with the abscissa on an enlarged scale. The radiator 14 was a semicircular arcwise conductor plate of a 75 mm radius $r_1$ with the semicircular cutout 41 of a 55 mm radius $r_2$ defined concentrically with the outside shape of the arcwise conductor plate obtained by being wound one turn around a 50 mm diameter column whose generating line was defined by the center line Ox passing through the vertex 21 of the semicircular arcwise conductor. The helical antenna 62 as the second antenna adjusted to operate at 280 MHz was placed in the cutout 41 and was connected at one end to the vertex 21 of the semicircular arc of the cutout 41 of the radiator 14. The plane conductor ground plate 50 used was a 300 mm by 300 mm sheet of copper 0.2 mm thick. The power was fed via the feeding cable 31 passed through the through hole 51 made in the plane conductor ground plate 50 centrally thereof. The coaxial cable 31 had its center conductor connected to the vertex 21 of the radiator 14 and its outer conductor connected to the plane conductor ground plate 50. When the experimental results shown in FIG. 40 are compared with those of the ninth embodiment in FIG. 37A, it is seen that the same band characteristic is obtained even if the helical antenna 62 is incorporated in the cutout 41. FIG. 41 indicates that the combined use of the radiator 14 and the helical antenna 62 permits resonance at 280 Mhz as well. Thus, it is possible to achieve multiresonance and lower the lowest resonance frequency without changing the size of the antenna structure.

Figure 42:
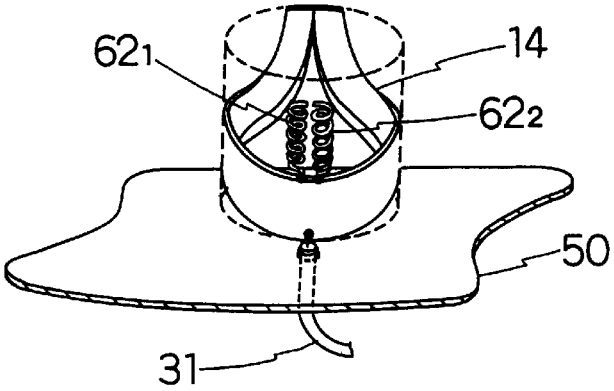
FIG. 42 is a diagram illustrating a modified form of the tenth embodiment.
Figure 43:
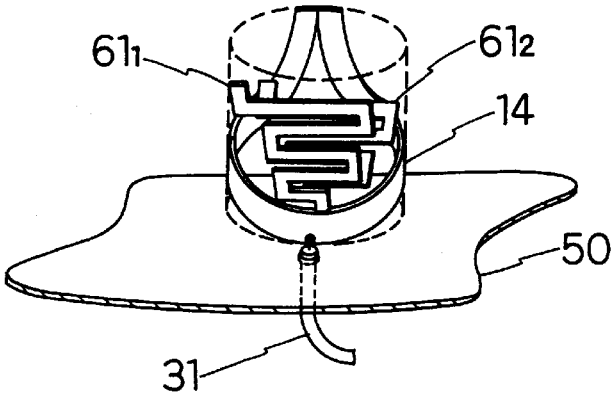
FIG. 43 is a diagram illustrating another modification of the tenth embodiment.
Figure 44:
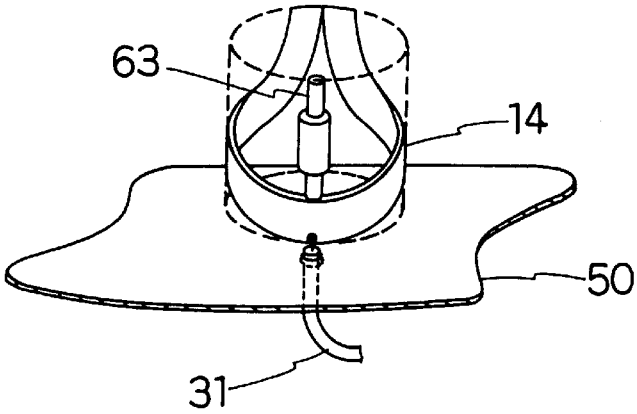
FIG. 44 is a diagram illustrating still another modification of the tenth embodiment.

FIGS. 42, 43 and 44 illustrate modified forms of the tenth embodiment, which use two helical antennas $\mathbf{62}_1$ and $\mathbf{62}_2$, two meander monopoles $\mathbf{61}_1$ and $\mathbf{61}_2$ and one resistance-loaded monopole 63 placed in the cutout 41 defined by the semicircular arcwise radiator 14, respectively. Any other types of radiating elements can be used as long as they can be accommodated in the cutout 41. While in FIGS. 42 and 43 two radiating elements are shown to be placed in the cutout 41, the number of radiating elements is not limited specifically thereto. The radiating elements are supplied with power via the radiator 14 to which they are connected.

By selecting a different resonance frequency for each of the radiating elements placed in the cutout 41 defined by the semicircular arcwise radiator 14, the number of resonance frequencies of the antenna can be further increased. In the case of FIG. 44, by setting the resonance frequency of the resistance-loaded monopole 63 to be lower than the resonance frequency of the semicircular conductor monopole antenna formed by the radiator 14, the lowest resonance frequency can be lowered without upsizing the antenna structure, and hence the band can be made broader. The resonance frequencies and impedances of the radiating elements or element placed in the cutout 41 and the radiator 14 are shifted to such an extent that their antenna operations do not affect each other.

Effect of the Invention

As described above, according to the first aspect of the present invention, the provision of the cutout defined by the semicircular arcwise radiator increases space factor while keeping the broadband characteristic. By placing one or more radiating elements in the cutout, it is possible to implement an antenna which has the same size as that of the conventional antenna but resonates at more frequencies and is broader in bandwidth or lower in the lowest resonance frequency.

According to the second aspect of the present invention, the semicircular radiator bent into a cylindrical shape occupies less space than in the prior art and the cutout defined by the cylindrical semicircular arcwise radiator increases the space factor. By placing in the cutout an antenna element different in shape and operating band from the semicircular arcwise radiator, it is possible to realize an antenna which is smaller in size but more broadband and more multiresonating or lower in the lowest resonance frequency that in the past.

It will be apparent that many modifications and variations may be effected without departing from the scope of the novel concepts of the present invention.

What is claimed is:

1. An antenna comprising:

a first radiator formed by a substantially semicircular conductor disc, said disc including a substantially semicircular cutout concentrically therewith forming a semicircular arc;

a plane conductor ground plate disposed opposed to said semicircular arc of said first radiator at right angles thereto; and a feeder connected to the vertex of the semicircular arc of said first radiator and said plane conductor ground plate, for feeding power across said first radiator and said ground plate.

2. The antenna of claim 1, further comprising a second radiator of about the same shape as that of said first radiator, said second radiator and said first radiator having center axes, respectively, which are coincident with one another.

3. An antenna comprising:

a first radiator formed by a substantially semicircular arcwise conductor having a semicircular cutout defined concentrically therewith to form a semicircular arc;

a second radiator formed by a substantially semicircular conductor disc and disposed with a vertex of said semicircular conductor disc opposed to a vertex of said semicircular arc of said first radiator; and a feeder connected to said vertexes of said first and second radiators, for feeding power across said first and second radiators.

4. The antenna of claim 3, further comprising:

a third radiator of about the same shape as that of said first radiator, said third radiator crossing said first radiator with the vertexes of their semicircular arcs held at the same point and having their center axes coincident with one another; and a fourth radiator of about the same shape as that of said second radiator, said fourth radiator crossing said second radiator with the vertexes of their semicircular conductor discs held at the same point and having their center axes coincident with one another.

5. The antenna of claim 3, wherein said second radiator has a semicircular cutout defined concentrically with its semicircular conductor disc.

6. The antenna of claim 1 or 3, further comprising at least one radiating element different in shape from said first radiator placed in said cutout and connected to the vicinity of said feeding point of said first radiator.

7. The antenna of claim 6, wherein said at least one radiating element is any one of a meander monopole, a resistance-loaded monopole and a helical antenna.

8. An antenna comprising:

a radiator formed by a substantially semicircular conductor disc bent into a cylindrical shape;

a plane conductor ground plate disposed opposite and apart from a vertex of a semicircular peripheral arc of said disc at substantially right angles to the generating line of said cylindrical shape; and a feeder connected to the vertex of said semicircular arc and to said plane conductor ground plate for feeding power across said radiator and said ground plate.

9. An antenna comprising:

a radiator formed by a first substantially semicircular conductor disc bent into a cylindrical shape;

another radiator formed by a second semicircular conductor disc having a center line aligned with a center line of said first semicircular conductor disc, said second semicircular conductor disc having a vertex opposed to a vertex of a peripheral semicircular arc of said first conductor disc apart therefrom; and a feeder connected to the vertexes of the semicircular arcs of said first and second conductor discs, for feeding power across said radiator and said another radiator.

10. The antenna of claim 9, wherein said another radiator is a cylindrical radiator formed by winding said second semicircular conductor disc into a substantially cylindrical shape.

11. The antenna of claim 9, wherein the first mentioned radiator has a substantially semicircular cutout defined substantially concentrically with the semicircular shape of its said conductor disc.

12. The antenna of claim 11, wherein at least one radiating element different in shape from the semicircular disc of the first mentioned radiator is placed in said cutout and connected to the first mentioned radiator.

13. The antenna of claim 12, wherein said at least one radiating element is any one of a meander monopole, a resistance-loaded monopole and a helical antenna.

* * * * *